US008893736B2

(12) United States Patent
Kazim

(10) Patent No.: US 8,893,736 B2
(45) Date of Patent: Nov. 25, 2014

(54) UMBRELLA FOLDING UPWARD AND INSIDE OUT

(76) Inventor: Jenan Kazim, St. Albans (GB)

( * ) Notice: Subject to any disclaimer, the term of this patent is extended or adjusted under 35 U.S.C. 154(b) by 127 days.

(21) Appl. No.: 13/496,724

(22) PCT Filed: Sep. 20, 2010

(86) PCT No.: PCT/GB2010/051577

§ 371 (c)(1),
(2), (4) Date: Jun. 4, 2012

(87) PCT Pub. No.: WO2011/033317

PCT Pub. Date: Mar. 24, 2011

(65) Prior Publication Data

US 2012/0240969 A1 Sep. 27, 2012

(30) Foreign Application Priority Data

Sep. 18, 2009 (GB) ..... 0916396.5

(51) Int. Cl.
*A45B 25/10* (2006.01)

(Continued)

(52) U.S. Cl.
CPC ..... *A45B 19/04* (2013.01); *A45B 25/24* (2013.01); *A45B 19/10* (2013.01);

(Continued)

(58) Field of Classification Search
CPC ..... A45B 19/04; A45B 19/00; A45B 25/10; A45B 2025/105; A45B 2019/002; A45B 2019/008
USPC ..... 135/15.1, 19.5, 20.3, 25.1, 25.3, 25.31, 135/25.41, 27–29, 31–32, 34.2, 48
See application file for complete search history.

(56) References Cited

U.S. PATENT DOCUMENTS 3,435,836 A * 4/1969 Vanzini ..... 135/22
3,534,752 A * 10/1970 Vanzini ..... 135/22

(Continued)

FOREIGN PATENT DOCUMENTS

CN 201205009 Y 3/2009
CN 101711621 5/2010

(Continued)

OTHER PUBLICATIONS

United Kingdom Search Report dated Jan. 18, 2011 in connection with GB Patent Appln. No. GB1015733.7.

(Continued)

*Primary Examiner* — Winnie Yip
(74) *Attorney, Agent, or Firm* — Grossman, Tucker, Perreault & Pfleger, PLLC

(57) ABSTRACT

A foldaway umbrella (10, 110, 210, 310, 410, 510) moveable between an open configuration and a closed configuration, said umbrella comprising: k) a central spine (12, 112, 212, 312, 312, 412, 512); l) an upper crown (24, 124, 224, 324, 424, 524) moveable with respect to the central spine; m) a lower crown (38, 138, 238, 338, 438, 538) fixed with respect to the central spine; n) a collapsible canopy framework (16, 116, 216, 316, 416, 516) connected to the upper crown and the lower crown; and o) a main canopy (18, 118, 218, 318, 418, 518) covering the collapsible canopy framework said main canopy (18, 118, 218, 318, 418, 518) covering the collapsible canopy framework said main canopy having an inside face closest to the collapsible canopy framework and an outside face crown from a position remote of the lower crown to a position close to the lower crown results in the collapsible canopy framework, and thus the main canopy, to move from the open configuration to the closed configuration wherein the main canopy is folded inside out such that only the inside face of the main canopy is exposed and vice versa.

10 Claims, 26 Drawing Sheets

(51) Int. Cl.

| | |
|---|---|
| ***A45B 19/10*** | (2006.01) |
| ***A45B 19/04*** | (2006.01) |
| ***A45B 25/14*** | (2006.01) |
| *A45B 25/24* | (2006.01) |
| *A45B 19/00* | (2006.01) |

(52) U.S. Cl.

CPC ..... *A45B 2025/105* (2013.01); *A45B 25/10* (2013.01); *A45B 2019/008* (2013.01); *A45B 25/14* (2013.01)

USPC ..... 135/20.3; 135/25.33; 135/25.41; 135/28; 135/27

(56) References Cited

U.S. PATENT DOCUMENTS

| | | | | |
|---|---|---|---|---|
| 3,709,238 | A * | 1/1973 | Leopoldi et al. | 135/15.1 |
| 4,007,753 | A * | 2/1977 | DeMarco | 135/25.33 |
| 5,909,746 | A | 6/1999 | Doster et al. | |
| 2004/0211451 | A1 * | 10/2004 | Goh | 135/31 |
| 2007/0089768 | A1 * | 4/2007 | Glasser | 135/19 |
| 2007/0169801 | A1 * | 7/2007 | Brader | 135/31 |

FOREIGN PATENT DOCUMENTS

| | | | | | |
|---|---|---|---|---|---|
| DE | 19505707 | | | 3/1996 | |
| EP | 0596180 | | | 5/1994 | |
| GB | 2329123 | | | 3/1999 | |
| GB | 2346556 | | | 8/2000 | |
| JP | 04067803 | A | * | 3/1992 | A45B 19/00 |
| JP | 08056725 | | | 3/1996 | |
| JP | 08056725 | A | * | 3/1996 | A45B 19/00 |
| JP | 2007181657 | A | * | 7/2007 | |
| JP | 2013141462 | A | * | 7/2013 | |

OTHER PUBLICATIONS

International Search Report dated Nov. 26, 2010 in connection with PCT Patent Appln. No. PCT/GB2010/051577.

* cited by examiner

UMBRELLA FOLDING UPWARD AND INSIDE OUT

FIELD OF THE INVENTION

The present invention relates to folding umbrellas. It is particularly applicable to folding umbrellas in which the umbrella canopy folds away inside out.

BACKGROUND

There have been many years of development in designing compact umbrellas, typically following the same principle of utilising a taut wire to stiffen the spokes that support the canopy. The spokes are normally in 3 or 4 hinged segments, which are foldable, with the canopy fabric being gathered around them. Normally a pouch is also provided for storing the folded umbrella. There are a number of disadvantages of the conventionally designed compact umbrellas as listed below:

The supporting spokes are folded such that the canopy fabric is gathered around them and a substantial part of the wet side of the fabric is on the outside.

The folding process requires handling of the wet fabric and even when fully folded it does not prevent water dripping from it.

A separate pouch is required to store the folded umbrella and as much of the fabric is loose and wet, it is difficult to store in a cover pouch. It is also difficult to incorporate the cover and the lid as part of a single unit.

The arrangement of the spokes, fabric and the folding process limits capacity of the umbrella frame to resist turning inside out against wind. The wire supported hinged spokes have no inherent stiffness to right themselves if the umbrella is blown inside out in the wind. The hinge mechanism presented in this invention is inherently stiffer and more stable.

Various attempts have been made to improve on the conventional umbrella design but, for various reasons, none have yet met with any significant commercial success. For example GB2329123 (Harasawa) describes an umbrella having a cylindrical sleeve used either as a handle or for storing the umbrella. However, although collapsible, the umbrella in this invention still folds up with the wet side outermost. An umbrella, which folds up reversibly, is known from JP08056725 (Okumura). However, this is not of the collapsible type. Furthermore, any water trapped within the canopy fabric is simply free to drain out if the furled umbrella falls over or is inverted.

EP0596180 (Vincenzi) describes an umbrella, which collapses into a handle. Once again, this is not of the collapsible type and, from the geometry of the struts and ribs, it is doubtful if this could ever be erected.

GB9903285 (Kazim) describes an umbrella that attempts to solve the shortcomings outlined above, but which dispenses with a central spine.

SUMMARY OF THE INVENTION

According to a first aspect of the present invention there is provided a foldaway umbrella moveable between an open configuration and a closed configuration, said umbrella comprising:

a) a central spine;

b) an upper crown moveable with respect to the central spine;

c) a lower crown fixed with respect to the central spine;

d) a collapsible canopy framework connected to the upper crown and the lower crown; and e) a main canopy covering the collapsible canopy framework said main canopy having an inside face closest to the collapsible canopy framework and an outside face remote from the collapsible canopy framework;

wherein movement of the upper crown from a position remote of the lower crown to a position close to the lower crown results in the collapsible canopy framework, and thus the main canopy, to move from the open configuration to the closed configuration wherein the main canopy is folded inside out such that only the inside face of the main canopy is exposed and vice versa.

Preferably the central spine comprises an outermost section and an inner section, the inner section movable inside the outermost section.

Preferably the lower crown is fixed to the outermost section of the central spine and the upper crown is moveable with respect to the outermost section of the central spine.

Preferably movement of the inner section of the central spine out of the outermost section of the central spine results in the movement of the upper crown from a position close to the lower crown to a position remote from the lower crown.

Preferably the inner section of the central spine is connected to the upper crown by a string and pulley system.

Preferably the upper crown comprises an upper section and a lower section.

Preferably the upper section of the upper crown is movable with respect to the lower section of the upper crown.

Preferably the upper section of the upper crown is connected to the lower section of the upper crown with a connecting member.

Preferably the umbrella further comprises a compression spring to move the upper crown from a position remote of the lower crown to a position close to the lower crown.

Preferably the upper crown is not telescopically connected to the lower crown.

According to a second aspect of the present invention there is provided a umbrella frame comprising:

a) an inner strut;

b) an outer strut; and c) a hinge assembly pivotally connecting the inner strut to the outer strut;

wherein the hinge assembly is adapted to allow the outer strut to pivot about 180° from a closed position wherein the outer strut is parallel with the inner strut to an open position wherein the outer strut extends from the end of the inner strut Preferably the motion of the outer strut is actuated by means of a push pull rod which connects via a lever arm to the outer strut wherein pushing or pulling the push pull rod results in the outer strut pivoting the hinge assembly. Preferably the hinge assembly further comprises a spring rod the spring rod being adapted to resist movement of the outer strut about the hinge assembly without the movement being replicated by the push pull rod. This results in a wind resistant outer strut which will always return to its open rest position after being blown in the wind, but which will easily fold away when desired.

According to the present invention there is provided a foldaway umbrella moveable between an open configuration and a closed or stored configuration such that when it is closed, the wet side or outside of the canopy is folded upon itself substantially preventing water dripping and allows the user to handle the dry side of the canopy. A cover sleeve and lid provides further protection against leakage and dripping. Key components of an umbrella according to the present invention comprise:—

A Central Spine. This is telescopic, typically tubular structure that supports the canopy frame and the canopy. In its lowest section, it supports a handle grip. In its uppermost section it supports a pulley system holder. The uppermost section either has a vertical slit or a vertical groove along part of or whole of its length to allow a string system to run within it. The next section down from the uppermost section, run within the uppermost section and provides an anchor for the string system and incorporates latch system for locking the Central Spine and the canopy frame together when the canopy is fully opened.

Handle Grip is fixed on to the lowest segment of the Central Spine. This is also usually cylindrical and usually made out of plastic or wood. The sleeve cover for the umbrella can be fixed onto the handle grip. It can be made out of flexible material such as fabric which can roll up or down, or it can be made out of tubing, preferably telescopic with one or more segments and preferably see through to minimise its visual impact. Uniquely, the lid to the cover is incorporated onto it. The closing action of the cover closes the lid and the opening action opens it. The advantage of this is that the whole system, including the umbrella cover and the lid are part of the same unit. Alternatively, the lid of the cover can be a separate preferably cylindrical cap to cover the part of the umbrella on the opposite end to the handle or fabric fold and Velcro to fix it. This arrangement has the advantage that the umbrella folds up inside out as well as folding completely within the handle body and the cover. By then closing off the open end of the handle and the cover in some waterproof manner the dampness associated with a used umbrella is fully contained within the handle.

A Canopy Framework. Preferably comprises a plurality of support arms extending radially from the Central Spine. Each support arm comprising a series of pivotally linked struts in substantially linear end-to-end alignment. In this particular example there are two struts pivoted together for each arm extending from the centre. The inner strut is pivoted on to a Sliding Support which is designed to slide vertically along the uppermost section of the Central Spine. The inner end of the inner strut is shaped so that the central axis of the strut is offset from the pivot point on the Sliding Support. In its closed position, this offset allows the canopy frame to fold within the space between the inner strut and the Central Spine. It also has the added benefit of providing additional leverage for moving the inner arm. The inner arm is supported by a brace. The brace is pivoted on one end on to the inner arm and on the other end on to a Brace Support fixed on to the lower part of the outermost section of the Central spine.

Upper Crown or Sliding Support. Preferably made of plastic, it provides pivotal support for the inner struts. The upper crown is circular with a hole in the middle and slides up an down the central spine.

Lower Crown or Brace supports. Preferably made of plastic, it provides pivotal support for the brace for the inner strut. It also incorporates a pulley system that along with the string system and the pulley system on the top of the central spine facilitate the movement of the Sliding Supports. The lower crown is circular with a hole in the middle and is fixed to the central spine.

String System. It is designed so that opening action of the Central Spine moves the sliding support up, deploying the canopy. Closing of the Central Spine moves the Sliding Support down in towards the Brace Support, closing the canopy. Another feature of the string system is that it incorporates a loop on to the Sliding Support that partially de-couples the movement of the Central Spine Sections from the movement of the Sliding Support. This has an advantage of being able optimise the length of the section of Central Spine without being constrained by the movement range of the Sliding Support.

Hinge System. In this innovation, the outer strut is pivoted on to the inner strut and able to rotate with respect to the inner strut far beyond 180 degrees. To do this and then rotate the strut back to its original position on top of the inner strut is not possible with use of mechanical links. The present innovation overcomes this problem by ensuring that although the strut rotates more then 180 degrees the link point does not.

Actuation System for the hinge lever. The outer strut rotates by a rod pushing or pulling on the hinge lever arm. The length of the lever arm affects the force required to pull or push it. Longer the lever arm less the force. However, this has an impact on the size of the umbrella. The sliding support also has a pre-determent movement range and the rod pulling and pushing the hinge lever arm has to be moved the required distance within this movement range. The present invention solves this problem by providing a linkage system which is connected to the movement of the sliding support so that when the sliding support moves up, deploying the canopy, the linkage opens up pulling on the rod pulling the hinge lever arm open. Preferably the arm of the linkage connected to the pulling/pushing rod extends beyond its pivot and preferably sliding within the slit provided on the inner strut. The extent of which the link pulling the rod extends beyond the pivot is dependent on the required by the rod.

Main Canopy: This is made from typical materials used in the industry. It will have creased to ensure when closed the canopy fold in a pre-determined manner. Preferably the outer edge of the canopy between the struts will be creased or stiffened to prevent the outer edge of the canopy folding back on itself. The canopy will be stitched on to the struts so that in open position the canopy has a taut configuration. The innermost part of the canopy takes the shape of a fabric tube extending up away from the sliding support. The top of this tube is preferably left open to allow the wind pressure under the canopy to force the air flow through the tube and under the Mini Canopy covering the Crown of the umbrella. This allows the release of the wind pressure through the tube and out from under the Mini Canopy and over the top of the Main Canopy.

Latch Stop Spring. Preferably a latch is incorporated in the top but sliding section of the Central Spine. This latch will act as a stopper preferably acting on either on the Fixed Brace Support or on the uppermost section of the Central Spine. A unique feature of this innovation is that a small movement of the sliding support from its uppermost position results in a relatively large movement of the outer strut. A strong spring positioned between the latch and its stopper will facilitate this movement. This will allow the outer struts to move up in a control manner forced by a strong wind pressure, further releasing the force acting on the umbrella. When the wind pressure is released the spring pushes the spine down relative to brace support which pushes the sliding support up and the canopy back to its original position.

The present invention primarily relates to umbrellas. It is particularly applicable to folding umbrellas in which the umbrella canopy folds away inside out and preferably into the umbrella handle or a sleeve attached to the handle during storage. This folding arrangement keeps the wet side of the umbrella canopy away from the user and once folded, entraps the remaining water within the wet side of the canopy and prevents it from dripping out. Optionally, an umbrella casing cover or sleeve is so arranged to be an extension of the handle grip and to provide further seal against leakage. Uniquely, this cover is designed to minimise the visual impact on the handle and incorporates a unique lid.

The present invention provides an umbrella that can be folded dry side out in such a way to provide a substantial non-drip seal without a separate pouch and without the need to handle the wet side of the fabric. The present invention also incorporates a cover system attached to the handle grip. Uniquely this cover incorporates its lid as part of itself. Advantageously, umbrellas according to the present invention incorporates and inherent venting system as well as having inherent stiffness against being blown inside out in the wind. The specially developed folding process is also better suited for more compact packing of the fabric minimising its size and weight.

It is recognised by the inventor that the existing umbrellas, even with the weaknesses outlined above are commercial reality and as such they have public acceptance. This innovation maintains the visual and operational characteristics of the existing umbrellas but with added advantage of being dry to handling, non drip, wind resistant and inherently safer to fold.

BRIEF DESCRIPTION OF THE DRAWINGS

The invention will now be described by way of example only, with reference to the accompanying drawings in which.

DESCRIPTION OF THE PREFERRED EMBODIMENTS

Figure 1:
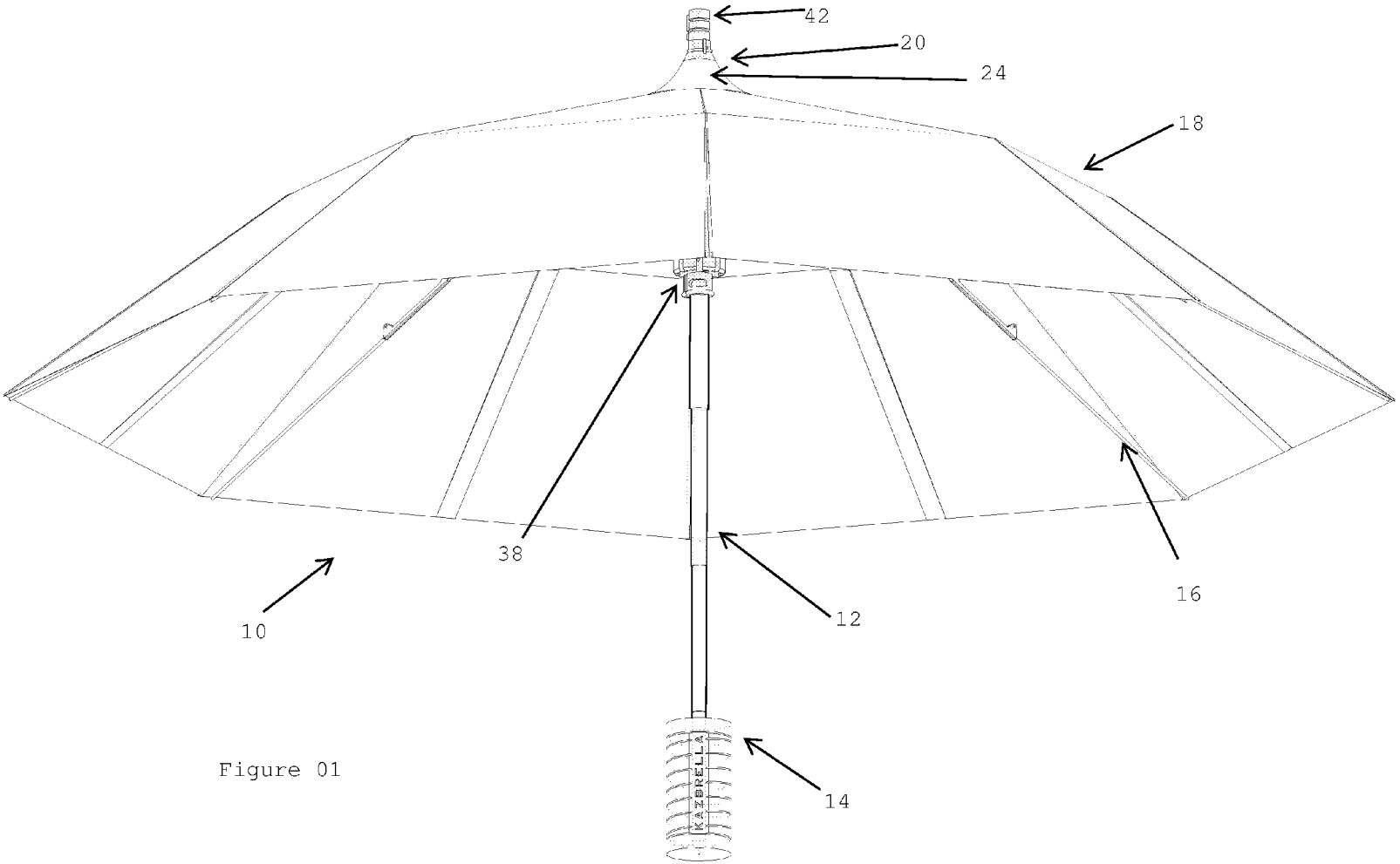
FIG. 1 illustrates an umbrella according to a first embodiment of the present invention in the open position.

Referring to FIG. 1 this illustrates an umbrella 10 according to a first embodiment of the present invention in its open position. The umbrella 10 has a central spine 12 a handle grip 14, a collapsible canopy framework 16, a main canopy 18 and a mini canopy 20. The main canopy 18 and the mini canopy 20 are both shown as being semi transparent so that the supporting collapsible canopy framework 16 is visible.

The central spine 12 is telescopic, typically tubular structure that supports the collapsible canopy framework 16 and the main canopy 18. In its lowest section, it supports a handle grip 14. In its uppermost section it supports a pulley system holder which will be described later.

The handle grip 14 is fixed on to the lowest segment of the central spine 12. This is also usually cylindrical and usually made out of plastic or wood. The optional sleeve cover (not shown) for the umbrella 10 can be fixed onto the handle grip 14.

Figure 3:
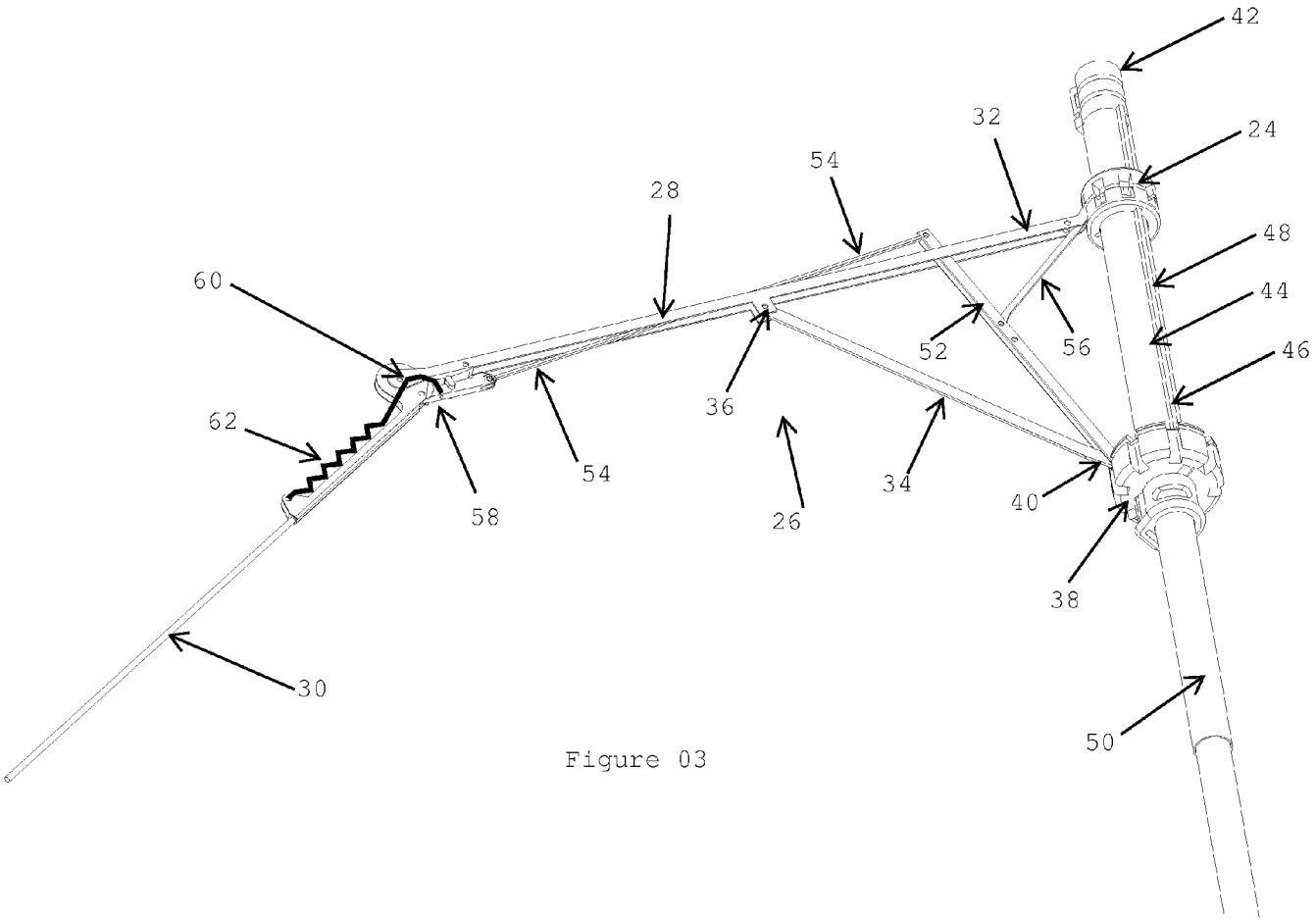
FIG. 3 illustrates an arm of the collapsible canopy framework of the umbrella according to a first embodiment of the present invention.

The collapsible canopy framework 16 comprises a plurality of support arms 22 extending radially from the central spine 12 (illustrated further in FIG. 3).

The main canopy 18 is made from typical materials used in the industry. It will be pre-creased to ensure when closed the main canopy 18 folds in a pre-determined manner. In one alternative the outer edge of the main canopy 18 between the support arms 22 of the collapsible canopy framework 16 will be creased or stiffened to prevent the outer edge of the main canopy 18 folding back on itself. The main canopy 18 will be stitched on to the support arms 22 of the collapsible canopy framework 16 so that in open position the main canopy 18 has a taut configuration.

Figure 2:
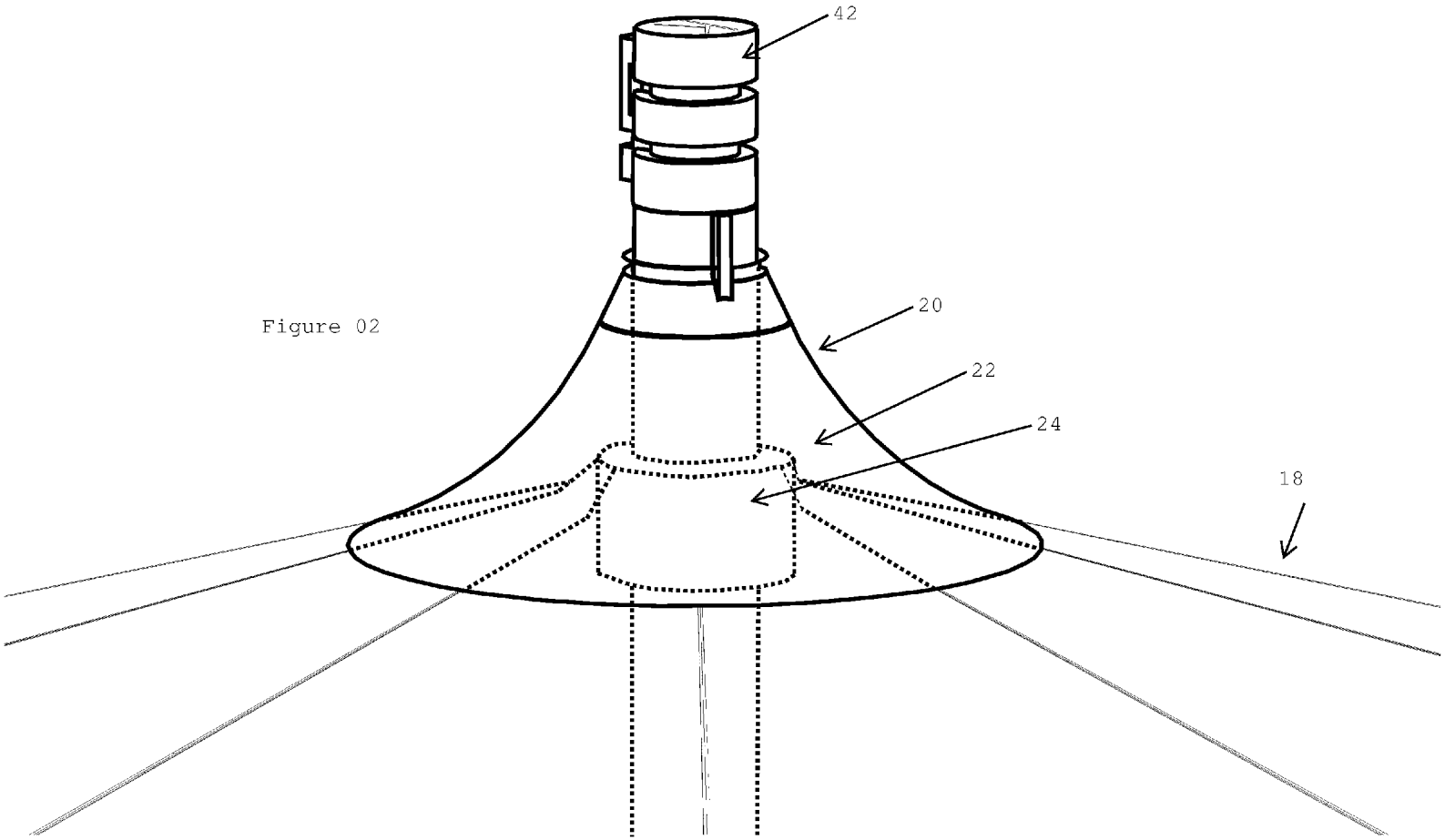
FIG. 2 illustrates an enlarged view of the top of the umbrella of FIG. 1.

Referring to FIG. 2 this illustrates an enlarged view of the top of the umbrella of FIG. 1. The innermost part of the main canopy 18 takes the shape of a fabric conical or tube 22 extending up away from the upper crown 24. The top of this conical or tube 22 is preferably left open to allow the wind pressure under the main canopy 18 to force the air flow through the conical or tube 22 and under the mini canopy 20 covering the upper crown 24 of the umbrella 10. This allows the release of the wind pressure through the conical or tube 22 and out from under the mini canopy 20 and over the top of the main canopy 18.

Referring to FIG. 3 this illustrates a support arm 26 of the collapsible canopy framework 16 of the umbrella 10 according to a first embodiment of the present invention. Each support arm 26 comprising a series of pivotally linked struts 28, 30 in substantially linear end-to-end alignment. In this embodiment there are two struts 28, 30 pivoted together for each arm extending from the centre. The inner strut 28 is pivotally connected to the upper crown 24, the upper crown 24 is designed to slide vertically along the uppermost section of the central spine 12. The inner end 32 of the inner strut 28 is shaped so that the central axis of the strut is offset from the pivot point on the upper crown 24. In its closed position, this offset allows the collapsible canopy framework 16 to fold within the space between the inner strut 28 and the central spine 12. It also has the added benefit of providing additional leverage for moving the inner strut 28. The inner strut 28 is supported by a brace 34. The brace 34 is pivotally connected on one end 36 on to the inner strut 28 and on the other end 40 to the lower crown 38. The lower crown 38 is fixed on to the lower part of the outermost section 44 of the central spine 12.

The upper crown 24 is made of a plastics material, it provides pivotal support for the inner struts 28.

The lower crown is made of a plastics material, it provides pivotal support for the brace 34 for the inner strut 28. It also incorporates a pulley system that along with the string system and the pulley system on the top of the central spine 12 facilitate the movement of the upper crown 24.

The string system is designed so that opening action of the central spine 12 moves the upper crown 24 up, deploying the canopy. Closing of the central spine 12 moves the upper crown 24 down in towards the lower crown 38, closing the canopy. Another feature of the string system is that it incorporates a loop on to the upper crown 24 that partially decouples the movement of the central spine sections from the movement of the upper crown 24. This has an advantage of being able optimise the length of the section of central spine 12 without being constrained by the movement range of the upper crown 24.

The top pulley system housing 42 not only provides support and housing for the pulley system which moves the upper crown 24 relative to the lower crown 38 it also provides support for the mini canopy 20 that is provided at the top of the central spine 12.

The uppermost section 44 of the central spine 12 has a vertical slit or groove 46 along part of or whole of its length to allow a string system 48 to run within it. The next section 50 of the central spine 12 down from the uppermost section 44, runs within the uppermost section 44 and provides an anchor for the string system 48 and incorporates latch system (shown more clearly in FIGS. 9 and 10) for locking the central spine 12 and the collapsible canopy framework 16 together when the main canopy 18 is fully opened The collapsible canopy framework 16 of the umbrella 10 is further provided with an actuation system 52 that facilitates the movement of the push and pull rod 54. The actuation system 52 is connected to both the upper crown 24 with connecting member 56 and the lower crown 38. When the lower crown 24 moves, the actuator system 52 moves forward or backwards pushing or pulling the push and pull rod 54.

The hinge mechanism 58 is adapted to allow the outer strut 30 rotate and come back beyond 180 degrees to fold back on the inner strut 28. The hinge mechanism has a hinge 60 and a spring 62 that acts to move the outer strut from the closed position (folded back on the inner strut 28) to the open position as illustrated in FIG. 3.

Figure 4:
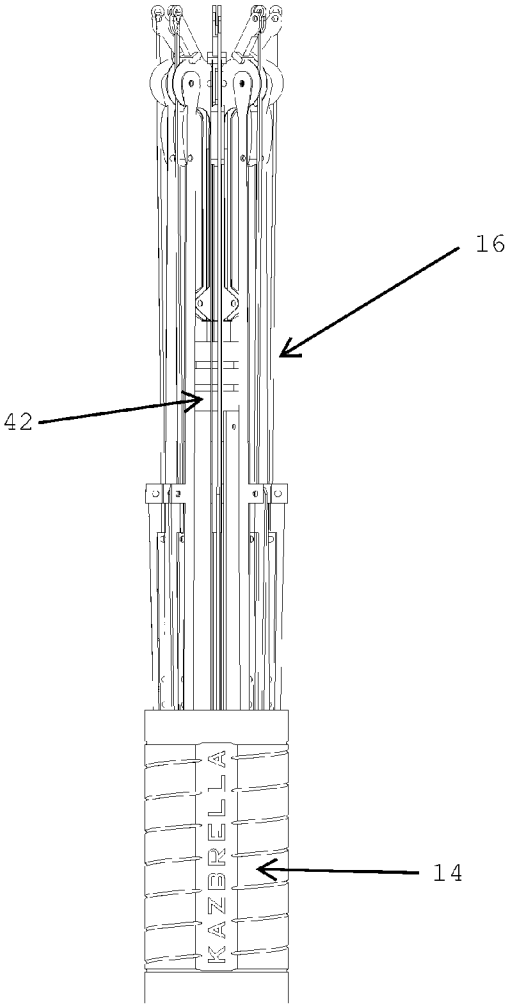
FIG. 4 illustrates the collapsible canopy framework according to a first embodiment of the present invention in closed configuration.

Referring to FIG. 4 this illustrates the collapsible canopy framework 16 according to a first embodiment of the present invention in closed configuration.

Figure 5:
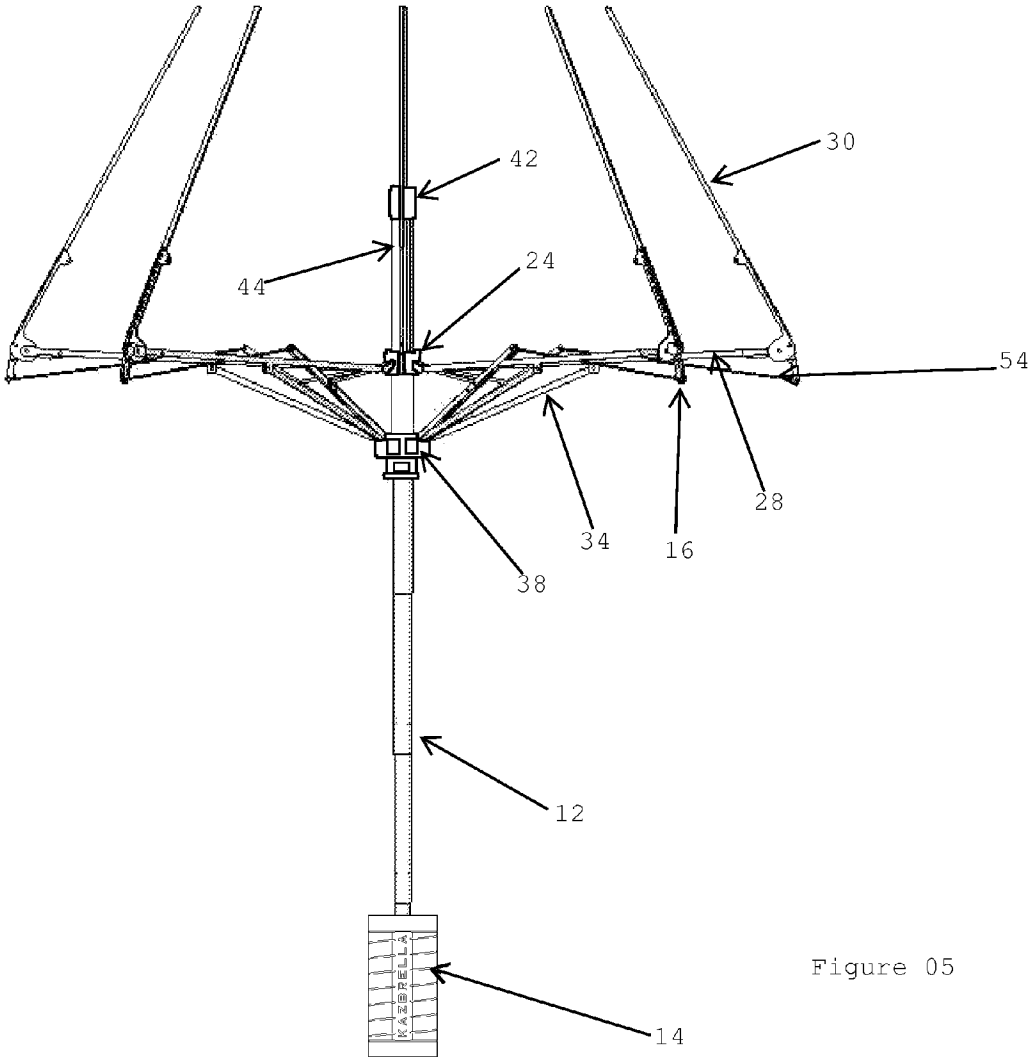
FIG. 5 illustrates the collapsible canopy framework according to a first embodiment of the present invention in partially open configuration.

Referring to FIG. 5 this illustrates the collapsible canopy framework 16 according to a first embodiment of the present invention in partially open configuration.

Figure 6:
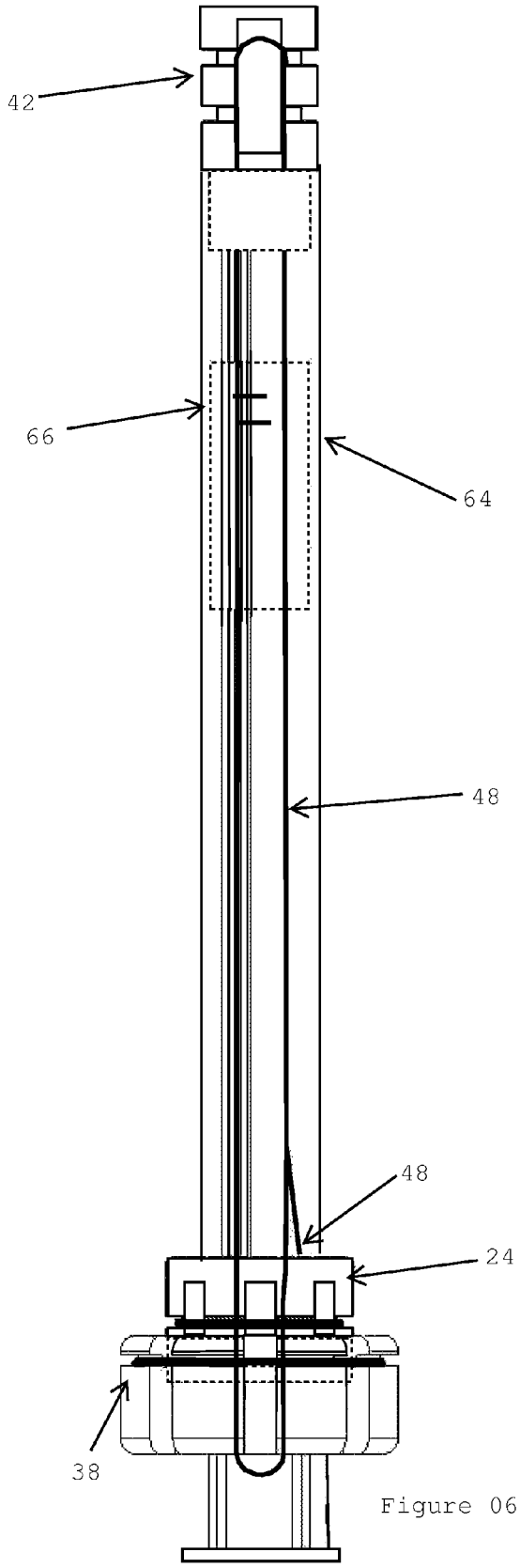
FIG. 6 illustrates the top of the central spine, upper crown and lower crown according to a first embodiment of the present invention.

Referring to FIG. 6 this illustrates the top of the central spine 12, upper crown 24 and lower crown 38 according to a first embodiment of the present invention.

The top pulley system housing 42 is located on the top of the outermost section 44 of the central spine 12 and houses a pulley system (not shown) for the string 48 that moves the upper crown 24. An anchor housing 64 is fixed on to the next section 50 of the central spine 12 which is located within the outermost section 44 of the central spine 12. The anchor housing 64 houses an anchor 66, for the string 48. When section 50 of the central spine 12 moves relative to outermost section 44 of the central spine 12, the string 48 moves the upper crown 24 up or down along the central spine 12. The string 48 in one alternative is also used to allow some movement in the anchor housing 64 without moving the upper crown 24. This is an advantage when optimising the lengths of the sections for the central spine 12. The string 48 is formed in a string loop from the anchor 66 up and over the top pulley system (not shown) which is housed in the top pulley system housing 42, down through the upper crown and over the lower pulley system (not shown) which is housed within the lower crown 38. The string 48 then goes up through the upper crown 24, where a knot is formed so that when the central spine 12 is being opened, the knot moves up away from the upper crown 24 until the string 48 is tight and as such pulls the upper crown 24 upwards opening the collapsible canopy framework 16 and thus the main canopy 18. When the central spine 12 is being closed, the string 48 moves the other way, the string 48 is loose and there is no movement on the upper crown 24 until the knot above the upper crown 24 makes contact with the upper crown 24. Thereafter, upper crown 24 moves down as the central spine 12 is being closed, folding the collapsible canopy framework 16 and thus the main canopy 18 to its closed configuration.

Figure 7:
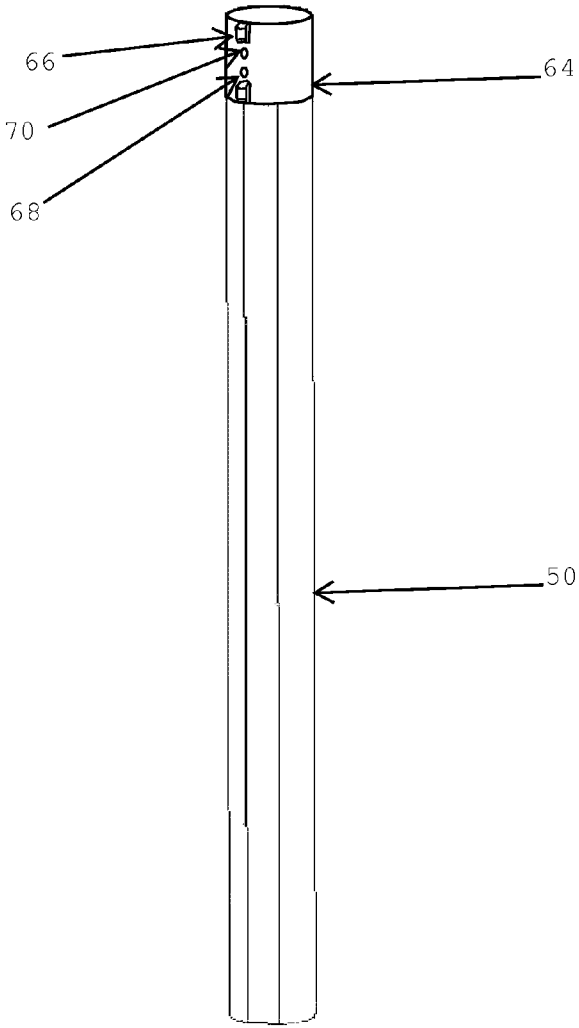
FIG. 7 illustrates the top of the central spine according to a first embodiment of the present invention.

Referring to FIG. 7 this illustrates the top of the central spine according to a first embodiment of the present invention. This Figure shows the inner section 50 of the central spine 12 and the string anchor housing 64 and anchor 66. The anchor is made up of two holes 68, 70. The string 48 is placed through the holes 68, 70 and secured with one portion string 48 going upwards the other downwards. The string anchor housing 64 in an alternative is also used to house the latch system which may be in the form of a latch mechanism or a hole for an external latch (illustrated in FIGS. 9 and 10).

Figure 8:
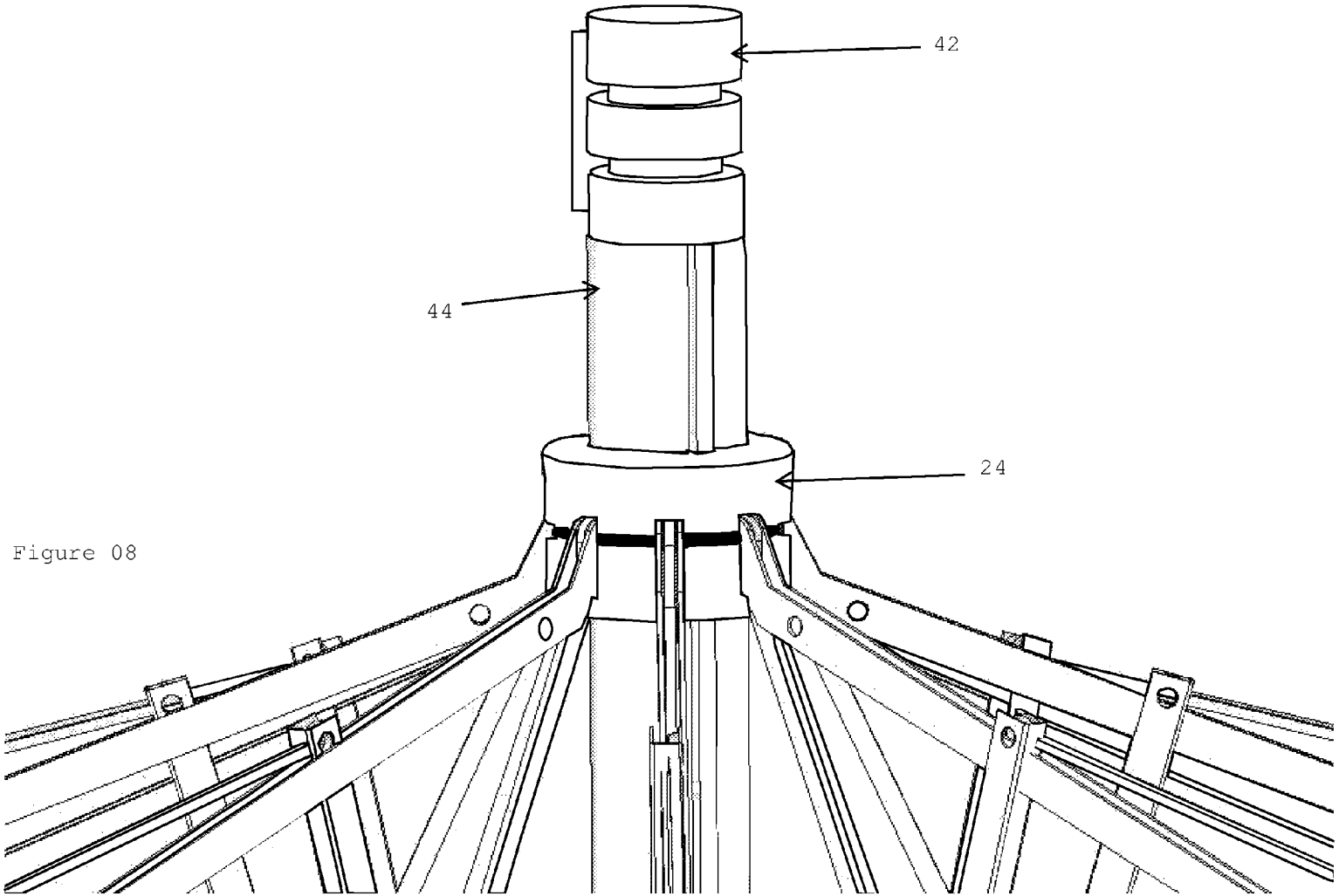
FIG. 8 illustrates an enlarged view of the top of the collapsible canopy framework according to a first embodiment of the present invention in a partially open configuration.

Referring to FIG. 8 this illustrates an enlarged view of the top of the collapsible canopy framework according to a first embodiment of the present invention in a partially open configuration. The opening of the umbrella 10 of the present invention is achieved as per conventional umbrellas by holding the lower crown 38 which is fixed on to the outermost section 44 of the central spine 12 with one hand and pulling the handle grip 14 with the other. This can also be automated by using springs between two top sections 44, 50 to open the handle 14. The reverse will be done to close the collapsible canopy framework 16 and thus the main canopy 18.

Figure 9:
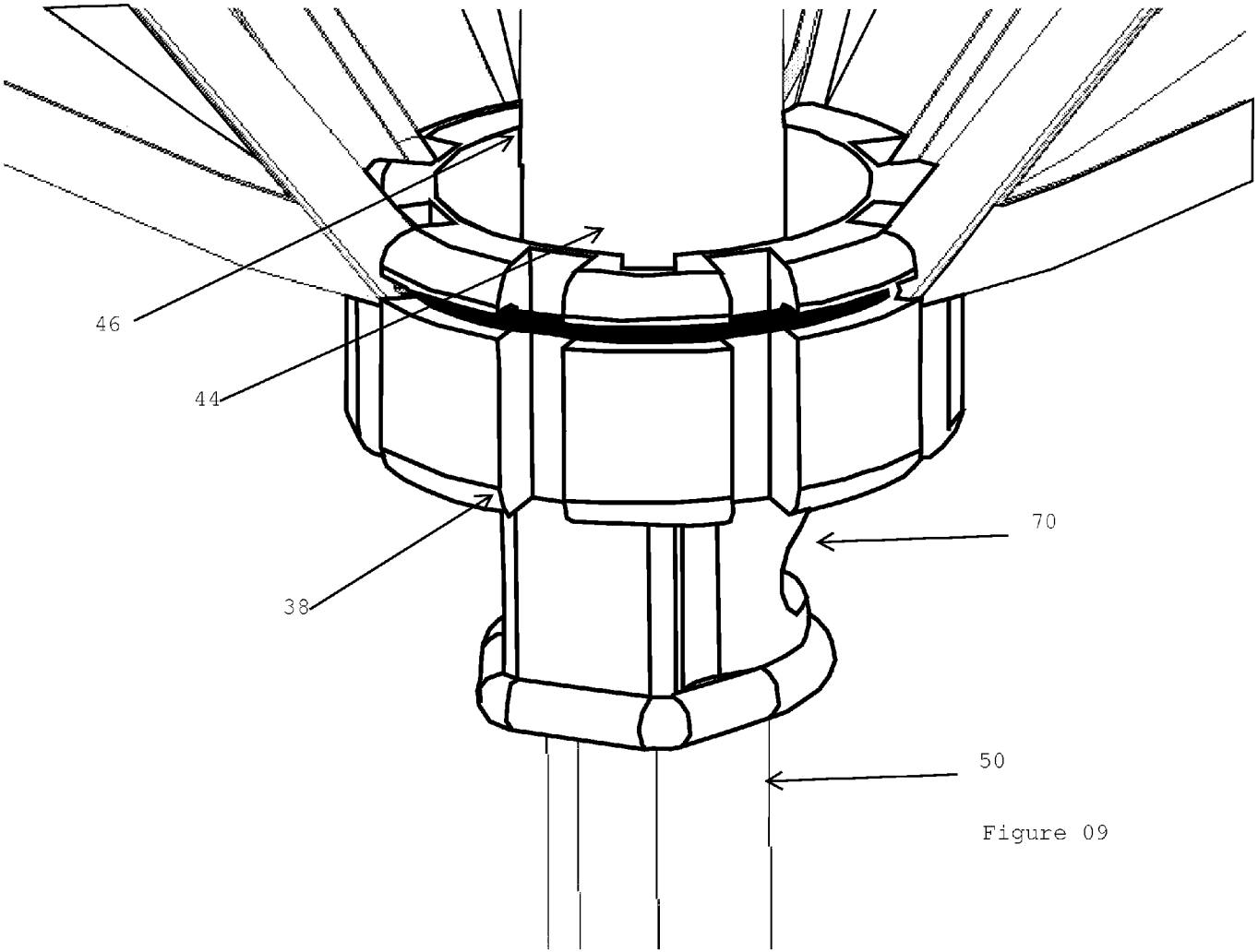
FIG. 9 illustrates an enlarged view of the lower brace support and the arm braces for the collapsible canopy framework where they connect to the lower crown according to a first embodiment of the present invention.

Referring to FIG. 9 this illustrates an enlarged view of the lower crown 38 and the braces 34 and actuator system 52 for the collapsible canopy framework 16 where they connect to the lower crown 38 according to a first embodiment of the present invention. A slit or a groove 46 is provided within which the string 48 moves.

Figure 10:
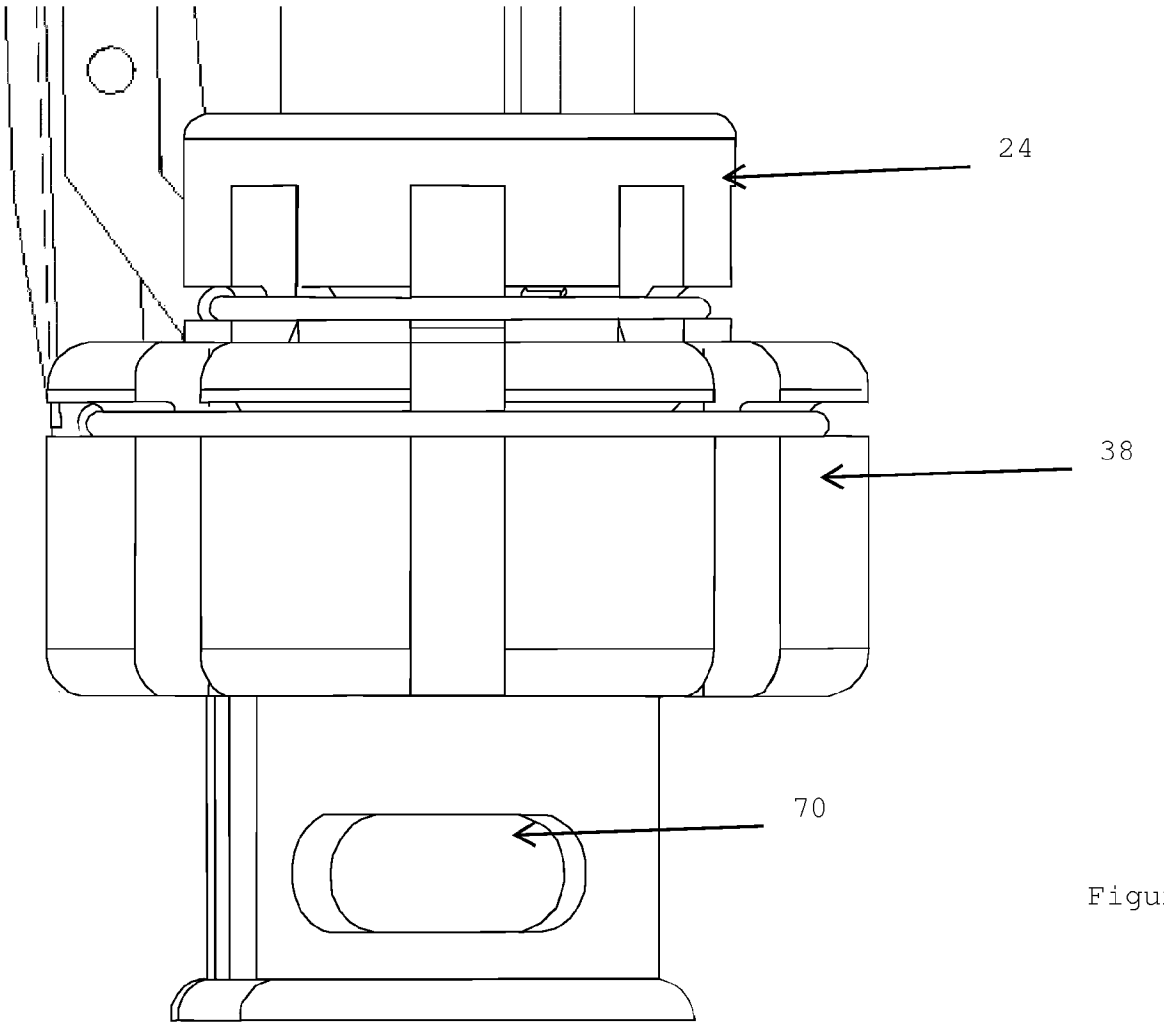
FIG. 10 illustrates an enlarged view of the lower crown according to a first embodiment of the present invention.

Referring to FIG. 10 this illustrates an enlarged view of the lower crown 38 according to a first embodiment of the present invention. In this view the upper crown 24 is substantially retracted in to the lower crown 38. The lower crown 38 is designed with the middle of its top part hollow to allow the upper crown 24 to be retraced in to it. This helps with the compactness of the umbrella 10. This figure show only part of the collapsible canopy framework 16 for clarity and the part of the central spine 12. In this version an optional latch 70 is shown that can lock the handle grip 14 in to position when the umbrella 10 is closed.

Figure 11:
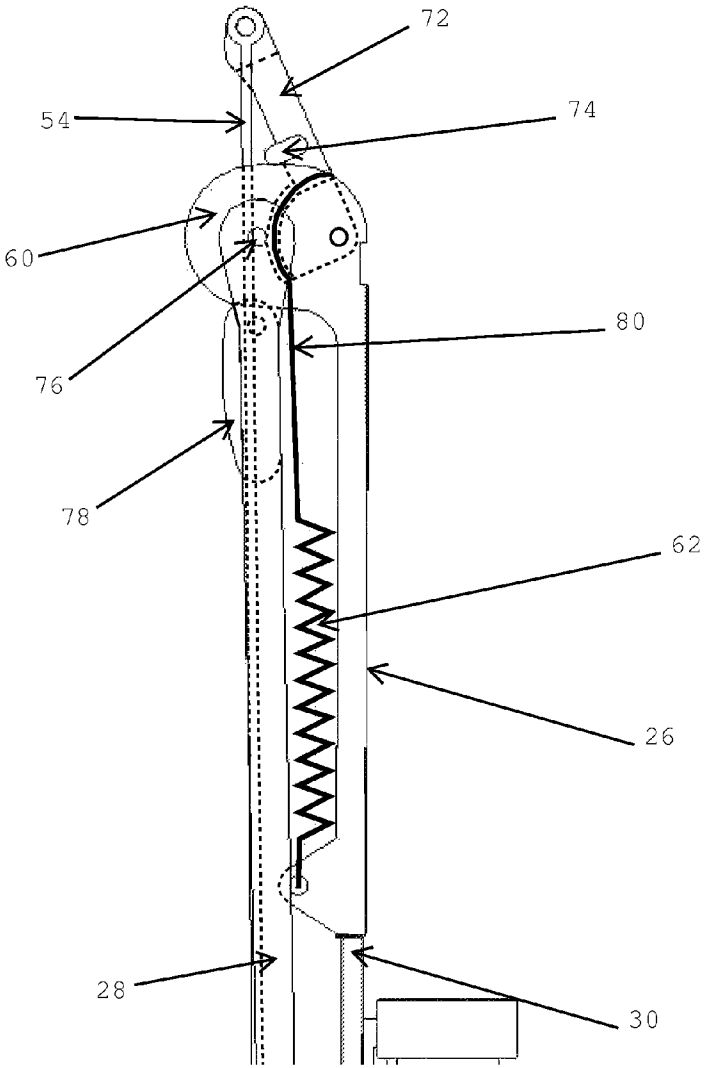
FIG. 11 illustrates an arm of the collapsible canopy framework of the umbrella in a closed position according to a first embodiment of the present invention.

Referring to FIG. 11 this illustrates an arm 26 of the collapsible canopy framework 16 of the umbrella 10 in a closed position according to a first embodiment of the present invention. In particular FIG. 11 shows the hinge mechanism 58 which connects the inner strut 28 and the outer strut 30. The hinge mechanism has a lever arm 72 with a stopper 74 that when in contact with the hinge 60 rotates the hinge around the pivot point 76 on inner arm. This movement is facilitated by the push, pull rod 54. When the lever arm 72 contacts the barrier 78 fixed on to inner arm 28 it slides along it. This forces the spring 62 to stretch by pulling the string 80 which is secured on the lever arm 72.

Figure 12:
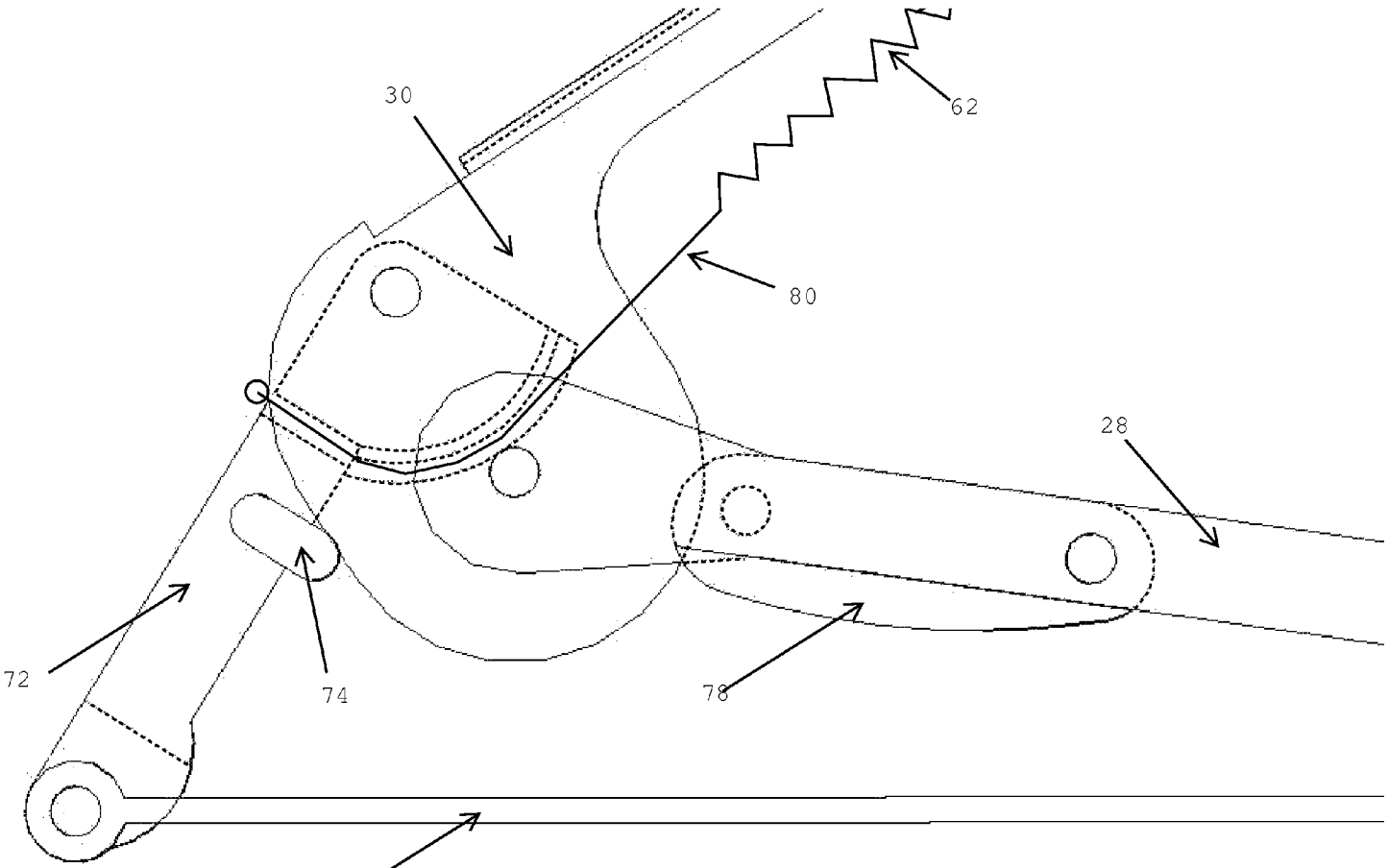
FIG. 12 illustrates an arm of the collapsible canopy framework of the umbrella in a partially open position according to a first embodiment of the present invention.

Referring to FIG. 12 this shows the hinge mechanism of FIG. 11 in partial open configuration.

Figure 13:
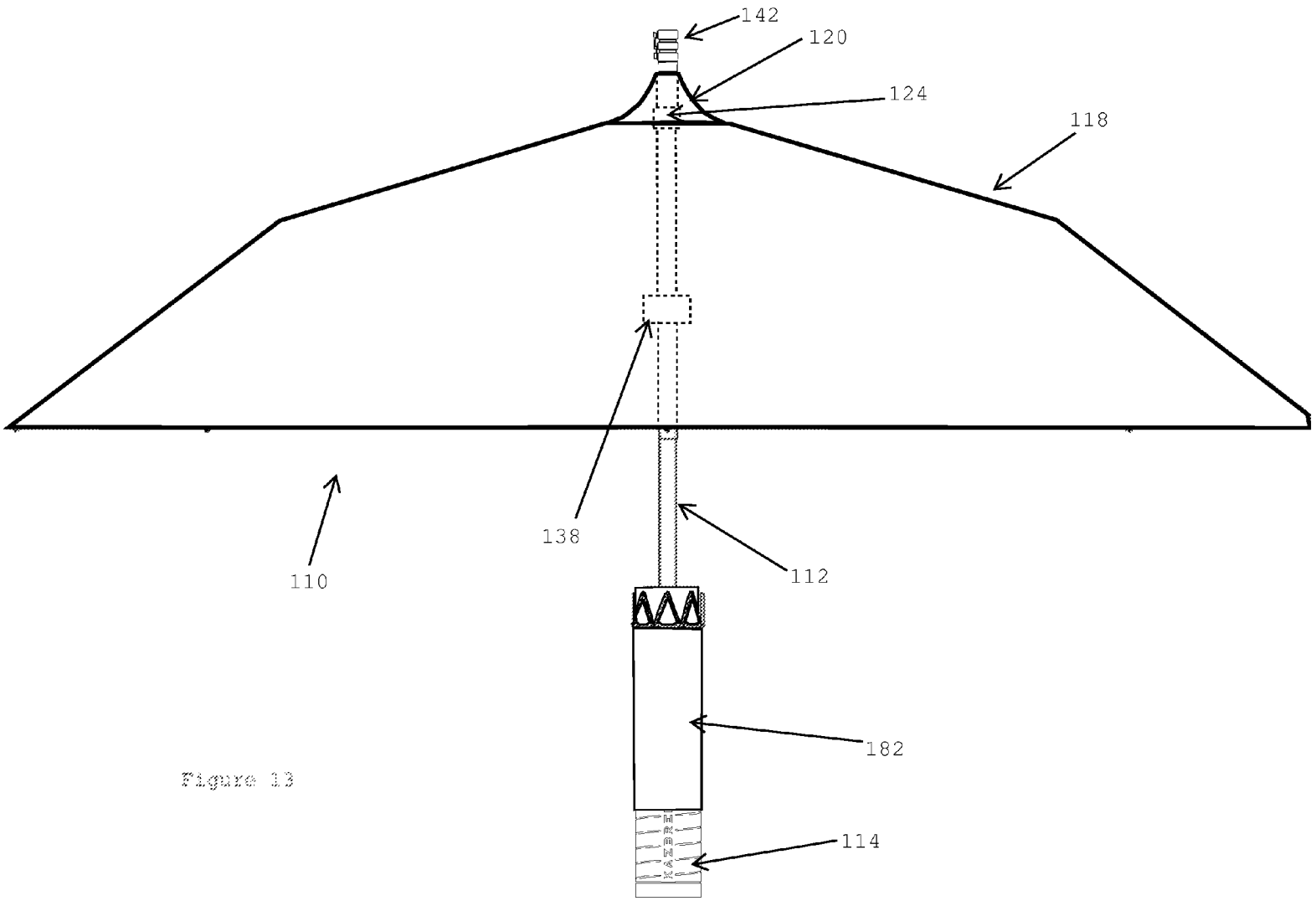
FIG. 13 illustrates an umbrella according to a second embodiment of the present invention in the open position with the sleeve present and retracted to its open position.

FIG. 13 illustrates an umbrella 110 according to a second embodiment of the present invention in the open position with the sleeve 182 present and retracted to its open position. The sleeve 182 can be made out of flexible material such as fabric which can roll up or down, or it can be made out of tubing, preferably telescopic with one or more segments and preferably see through to minimise its visual impact. Uniquely, the lid 184 to the sleeve 182 is incorporated onto it. The closing action of the sleeve 182 closes the lid 184 and the opening action of the sleeve 182 opens the lid 184. The advantage of this is that the whole system, including the umbrella 110 and the lid 184 are part of the same unit. Alternatively, the lid 184 of the sleeve 182 can be a separate preferably cylindrical cap to cover the part of the umbrella 110 on the opposite end to the handle 114 or fabric fold and Velcro to fix it. This arrangement has the advantage that the umbrella 110 folds up inside out as well as folding completely within the handle 114 body and the sleeve 182. By then closing off the open end of the handle 114 and the sleeve 182 in some waterproof manner the dampness associated with a used umbrella 110 is fully contained within the handle 114.

Figure 14:
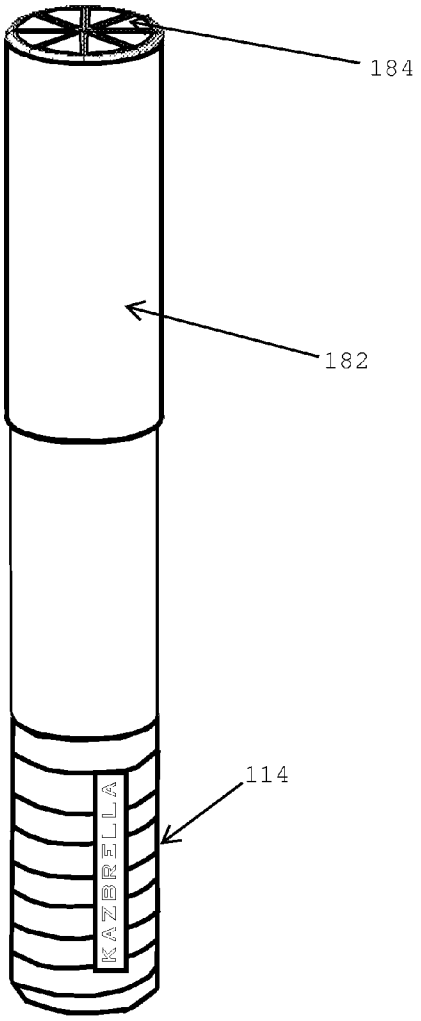
FIG. 14 illustrates an umbrella according to a second embodiment of the present invention in the closed position with the sleeve present.

FIG. 14 illustrates an umbrella 110 according to a second embodiment of the present invention in the closed position with the sleeve present 182.

Figure 15:
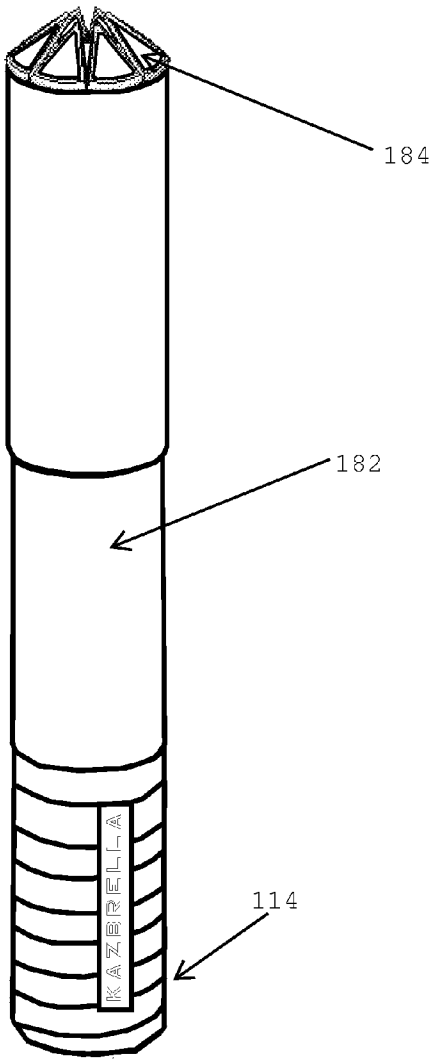
FIG. 15 illustrates an umbrella according to a second embodiment of the present invention in the closed position with the sleeve present and partially open.

FIG. 15 illustrates an umbrella 110 according to a second embodiment of the present invention in the closed position with the sleeve 182 present and partially open.

Figure 16:
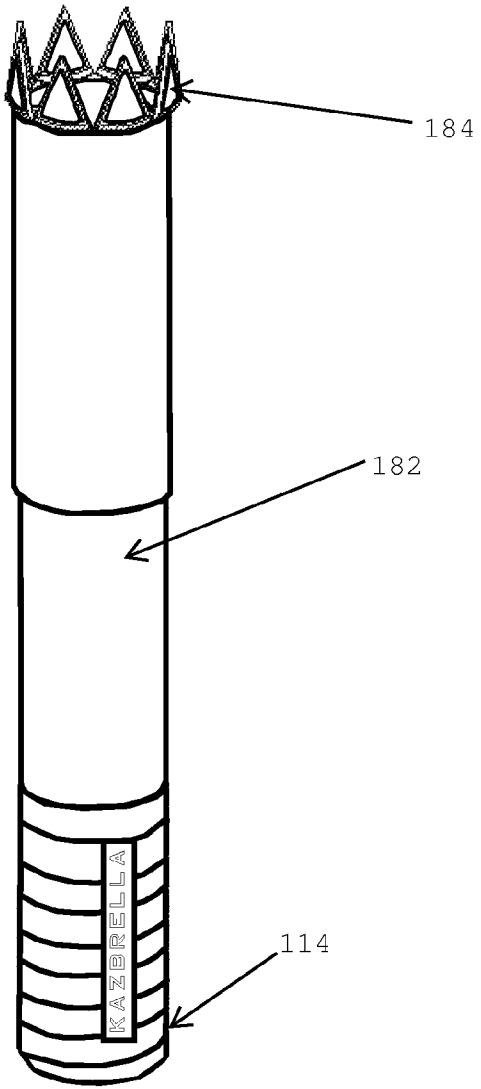
FIG. 16 illustrates an umbrella according to a second embodiment of the present invention in the closed position with the sleeve present and fully open.

FIG. 16 illustrates an umbrella 110 according to a second embodiment of the present invention in the closed position with the sleeve 182 present and fully open.

Figure 17:
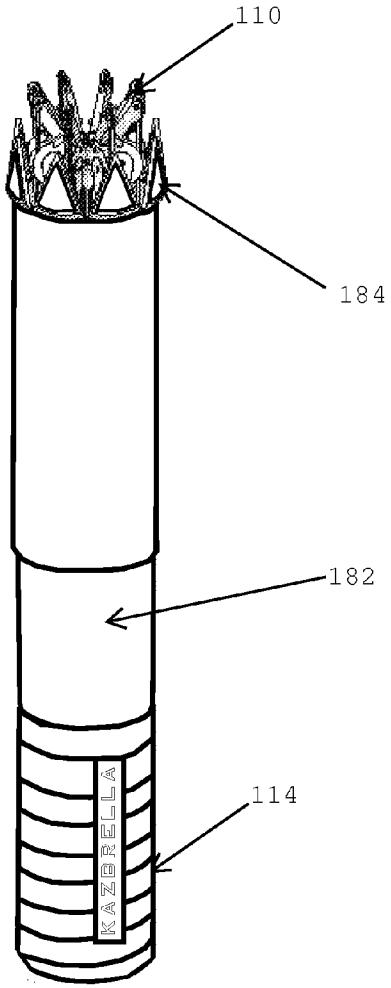
FIG. 17 illustrates an umbrella according to a second embodiment of the present invention in the closed position with the sleeve present and fully open and the umbrella beginning to emerge from the sleeve.

FIG. 17 illustrates an umbrella 110 according to a second embodiment of the present invention in the closed position with the sleeve 182 present and fully open and the umbrella 110 beginning to emerge from the sleeve 182.

Figure 18:
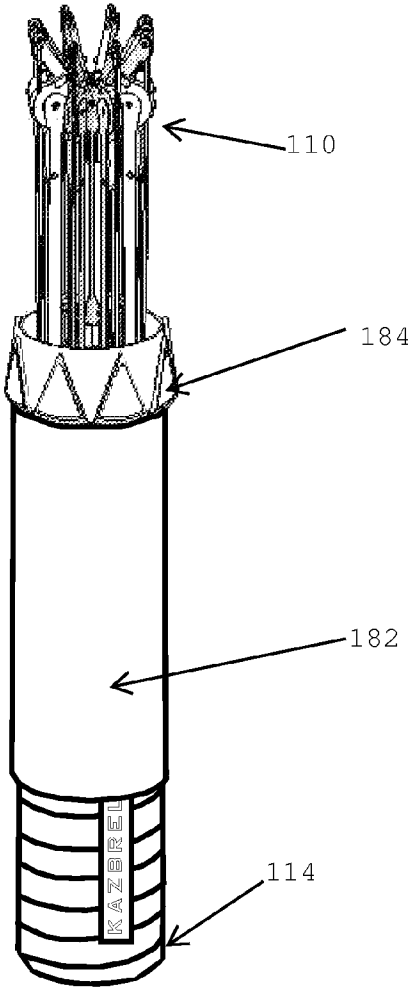
FIG. 18 illustrates an umbrella according to a second embodiment of the present invention in the closed position with the sleeve present and fully open and the umbrella emerging further from the sleeve.

FIG. 18 illustrates an umbrella 110 according to a second embodiment of the present invention in the closed position with the sleeve 182 present and fully open and the umbrella 110 emerging further from the sleeve 182.

There are two possible ways the braces and the inner struts can be arranged and they are both equally applicable to the present invention. They can either be arranged so that the inner struts 28, 228 are connected to the upper crown 24, 224 and the braces 34, 234 to the lower crown 38, 238, as shown in FIG. 3 and in FIG. 19 or the other way round, where the inner struts 328 are connected to the lower crown 338 and the braces 334 to the upper crown 324 as shown in FIG. 20.

Figure 19:
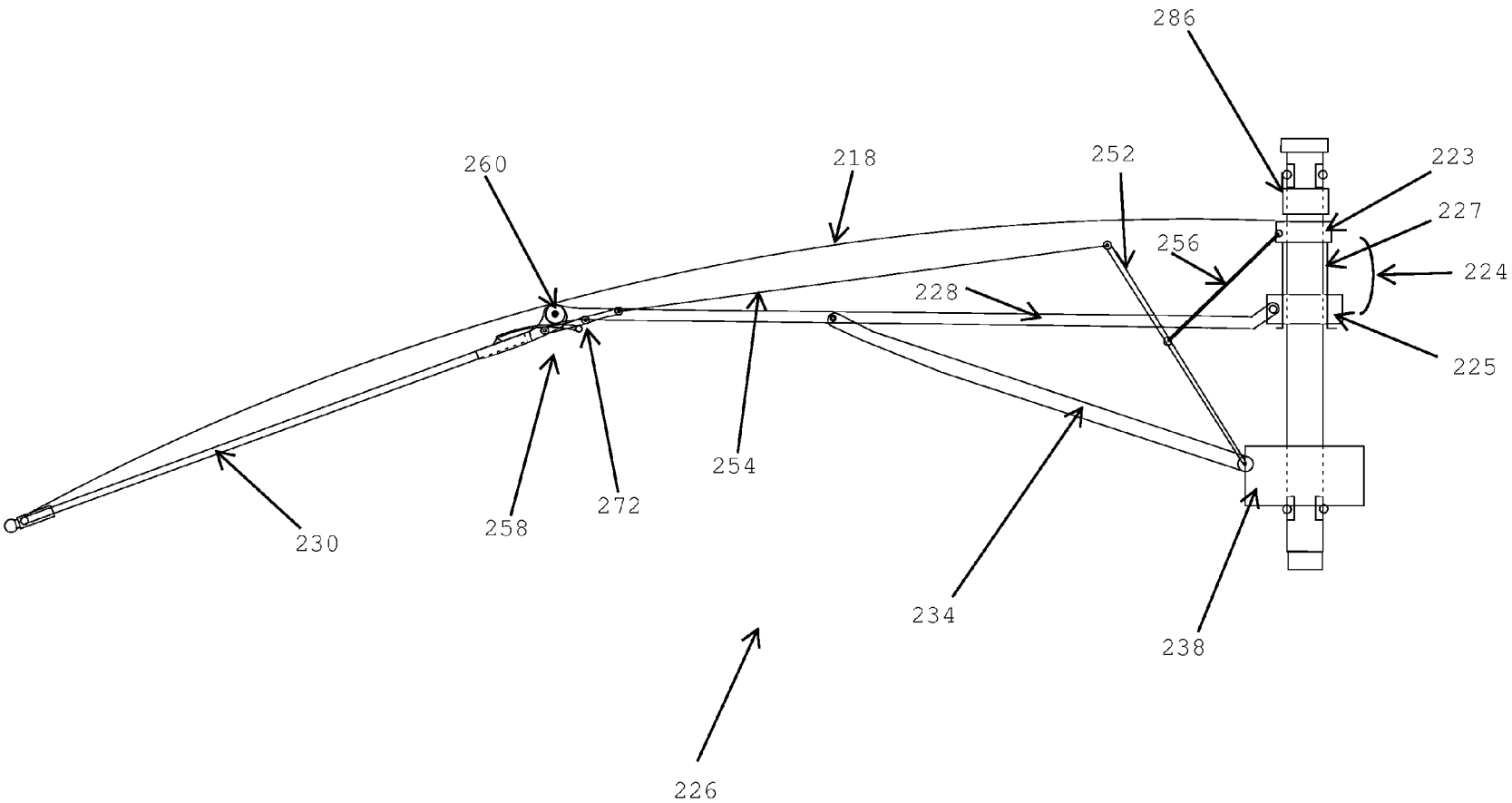
FIG. 19 illustrates an arm of the collapsible canopy framework of the umbrella according to a third embodiment of the present invention.

Referring to FIG. 19 this illustrates an arm 226 of the collapsible canopy framework 216 of the umbrella 210 according to a third embodiment of the present invention. In this case, inner strut 228 is shown on top and the brace 234 at the bottom. The upper crown 224 is shown in two sections, upper section 223 supports the connecting member 256 which connects to the actuation system 256 and the lower section 225 supports the inner strut 228. The brace 234 is supported by the lower crown 238 which also supports the connecting member 256 of the secondary linkage. The connector 277 which connects the two sections 223, 235 of the upper crown 234 allows the upper section 223 to move independently of the lower section 225 up to a certain height and couple them thereafter. On the way down the upper section 223 is free to move until in contact with the lower section 225. In an alternative this can also be achieved using strings or fabric joining the upper section 223 and the lower section 235 of the upper crown 234

When there is a movement forcing the lower crown 238 and upper crown 224 apart, this causes the primary linkage arms being the inner strut 228 and brace 234 as well as secondary linkage arms being the connecting member 256 and actuation system 252 to open up. This action pulls the push pull rod 254 connected to the lever arm 272 rotating the hinge 260 opening the outer strut 230. The main canopy 218 is stretched by the collapsible canopy framework 216 of the umbrella 210. A compression spring 286 can be used to push the upper crown 224 back down to close the collapsible canopy framework 216 of the umbrella 210.

Figure 20:
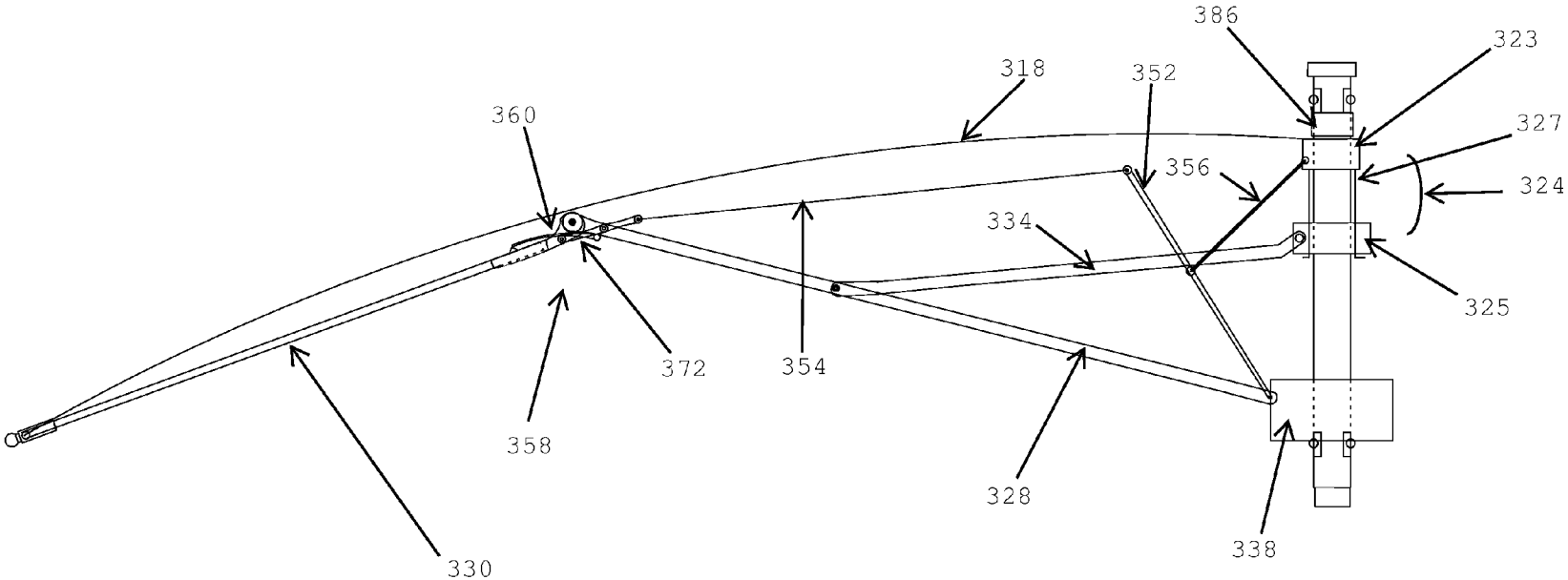
FIG. 20 illustrates an arm of the collapsible canopy framework of the umbrella according to a fourth embodiment of the present invention.

Referring to FIG. 20 this illustrates an arm 326 of the collapsible canopy framework 316 of the umbrella 310 according to a fourth embodiment of the present invention. FIG. 20 is essentially the same as FIG. 19 but in this case the primary linkage brace 334 is on top and is connected to the lower section 225 of the upper crown 224 and the inner strut 328 is connected to the lower crown 338.

Figure 21:
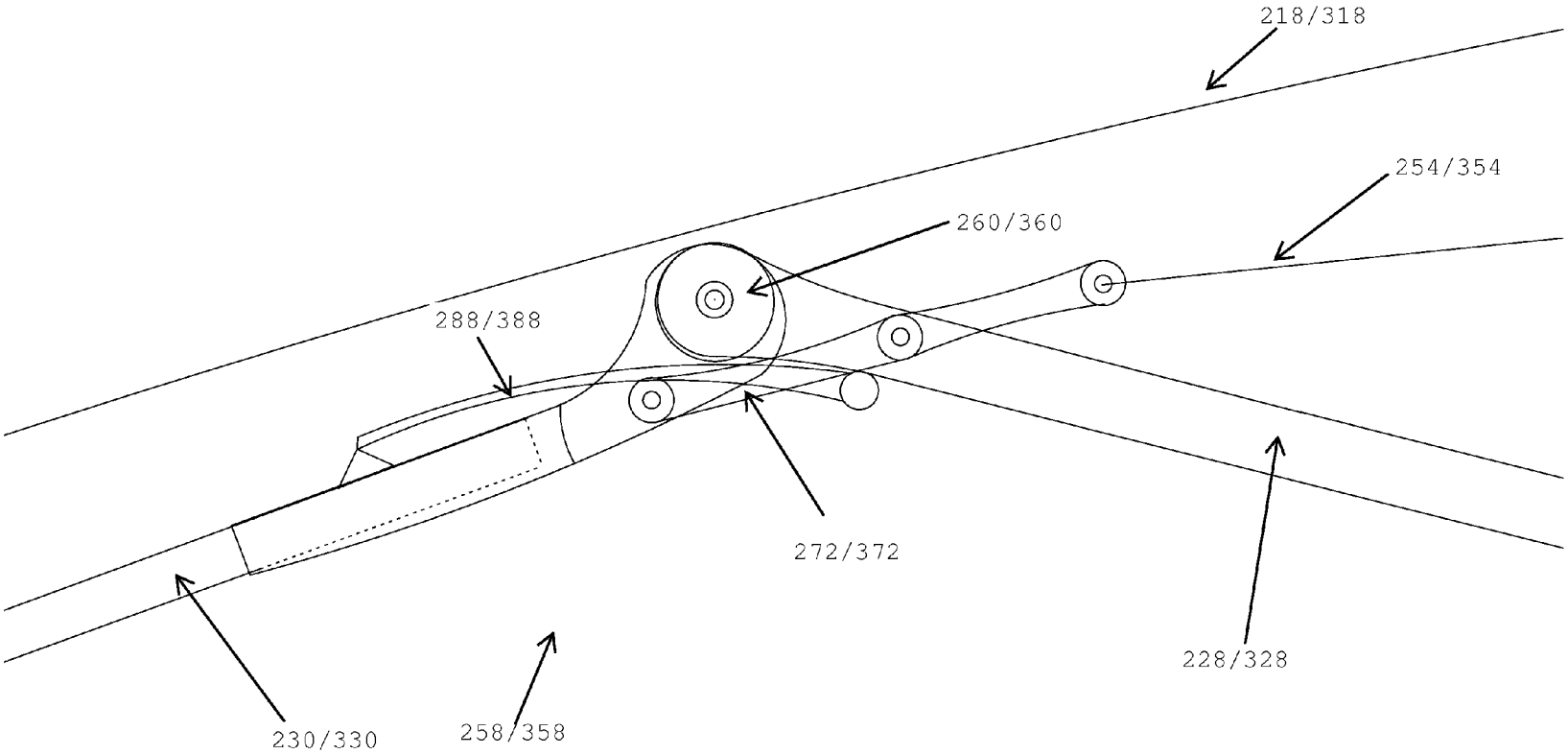
FIG. 21 illustrates an enlarged view of the hinge arrangement shown in FIGS. 19 and 20 according to the third and fourth embodiments of the present invention.

FIG. 21 shows the hinge arrangement 258, 358 shown in FIGS. 19 and 20 in more detail. The push pull rod 254, 354 is actuated by the movement of the actuation system 252, 352. This in turn pushes or pulls the lever arm 272, 372, which in turn rotates the outer strut 230, 330. The spring rod 288, 388 gives spring support to lever arm 272, 372. In order to rotate the outer strut to the open position the lever arm 272, 372 is pulled until it contacts the hinge casing 260, 360. When pushed, the lever arm 272, 372 supported by the spring rod 288, 388 forces the outer strut 230, 330 to rotate and close on to the inner strut 228, or brace 334.

FIGS. 3, 19 and 20 show one arm. The collapsible canopy framework of the umbrella will be made from one or a number of arms to suit specific application. The movement of the supports relative to each other around the central spine facilitate the opening and closing of the collapsible canopy framework. FIG. 19 shows an alternative arrangement to that shown in FIG. 3 where top support can be made in two parts, partially connected so that the outer strut can be actuated differently to the inner strut. It also may help make the manufacturing process easier.

Typically with conventional umbrellas, the opening of the collapsible canopy framework is achieved by moving the upper and lower crowns towards each other and closing of the collapsible canopy framework is achieved by moving the upper and lower crowns away from each other. In order to seal the inner part, around the crown of the canopy and minimise the excess loose fabric around the frame, the crown of the canopy is best pulled down towards the lower part of the folded frame close to the bottom support. This allows the largest, outermost part of the fabric to be folded in and contained by the much smaller inner part and substantially improves the seal for water contained within the canopy. It is not possible to achieve the above objective by opening and closing the frame this convention way.

This problem is fundamentally solved by the present invention by moving the supports in the opposite way to the current convention. In this invention, the opening of the frame is achieved by moving the upper and lower crowns away from each other and closing of the frame is achieved by moving the upper and lower crowns towards each other.

FIGS. 22 to 26 show some of the ways the two supports can be made to move apart during unfolding of the frame and come closer during folding, without altering the current operating practices. For example, when unfolding the umbrella, the frame is held whilst, the telescopic central spine is pulled open to near its full length and then the bottom support is pushed away from the handle grip to unfold the frame. The reverse is done to close the frame. This is operationally same as the conventional umbrellas. There are many ways this can be achieved, some of which are listed below as further embodiment of the same invention.

Figure 22:
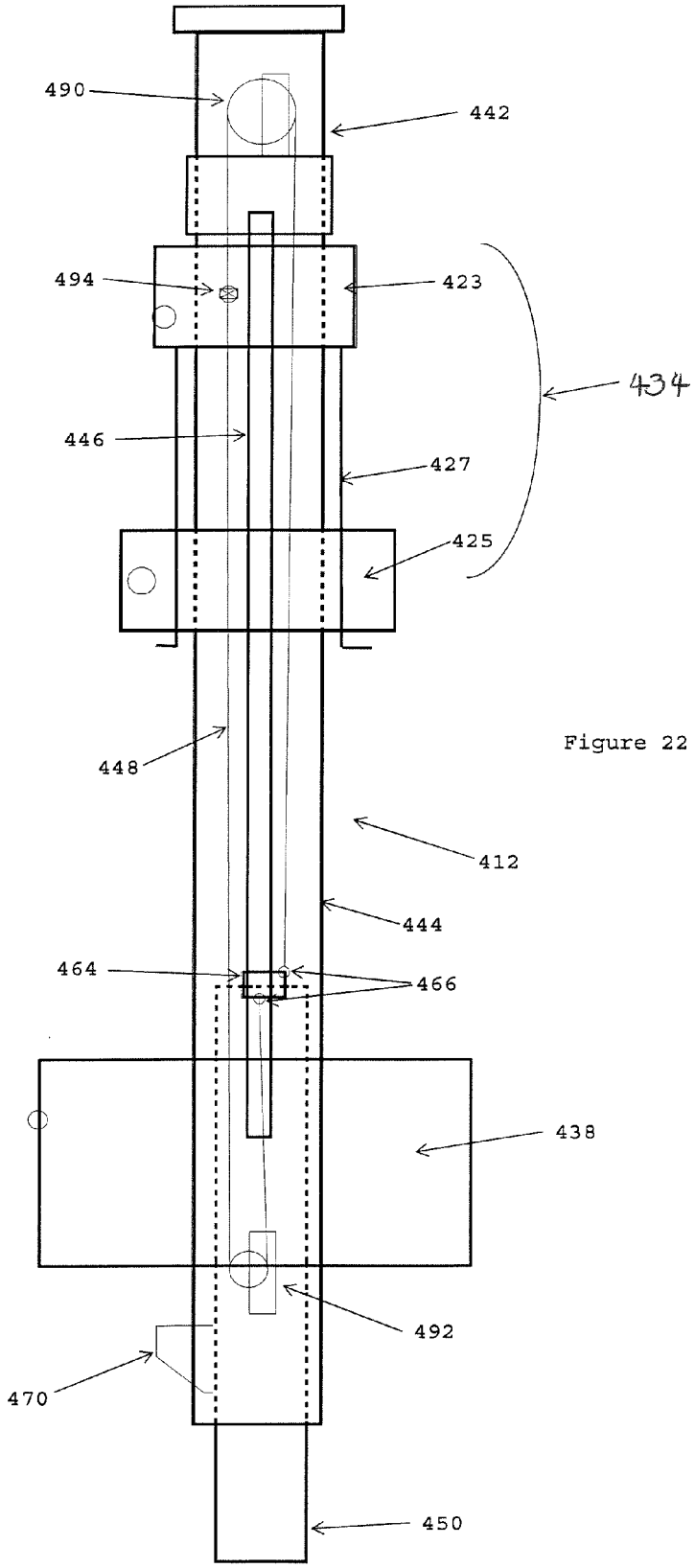
FIG. 22 illustrates the top of the central spine, upper crown and lower crown according to a fifth embodiment of the present invention.

Referring to FIG. 22 this illustrates the top of the central spine, upper crown and lower crown according to a fifth embodiment of the present invention. The opening and closing action of the collapsible canopy framework of the umbrella in this embodiment is facilitated by a string and pulley system attached to a segment of the telescopic central spine within the outermost segment. In this example string 448 is shown to run within a grove or slot 446 on the outermost segment 444 of the central spine 412. When the handle 414 is pulled, the string loop 448 which is also attached to the upper section 423 of the upper crown 424 rotates pulling up the upper section 423 and the lower section 425 of the upper crown 424. When the handle 414 is pushed against the outermost segment 444, the string loop 448 rotates the other way pulling the upper section 423 and the lower section 425 of the upper crown 424 down towards the lower crown 438.

FIG. 22 shows one way the upper crown 424 and lower crown 438 can be made to move relative to each other, thus actuating the closing and opening of the umbrella 410. In this case the lower crown 438 is fixed to the outermost segment 444 of the central spine 412. This outermost segment 444 has a slit or groove 446 on it. The slit or groove 446 allows the anchor housing 464 to connect the string 448 from the top pulley 490 and the string 448 from the bottom pulley 492 to the inner segment 450 of the central spine 412. The other end of the string 448 from the top pulley 490 as well as the other end of the string 448 from the bottom pulley 492 are connected to the upper section 423 of the upper crown 424 via a connector or knot 494. When the inner section 450 of the central spine 412 is pulled down relative to outermost section 444 of the central spine, the connector anchor pulls the string 458 over the top pulley 490 down, which makes the upper section 423 of the upper crown 424 go up. When the inner section 450 of the central spine 412 is pushed up further in to the outermost section 444 of the central spine 412, the anchor 464 goes up pulling the string 448 from the bottom pulley 492 up with it, which in turn pulls the upper section 423 of the upper crown 424 down. The latch 470 is used to fix the outermost section 44 to the inner section 450 of the central spine when the umbrella 410 is fully deployed. When the inner section 450 is pulled outwards from the outermost section 444, the arms around the outermost section move away from each other, opening the collapsible canopy framework 416 and the opposite happens when the inner section 450 is pushed in to the outermost section 444 of the central spine 412.

The top pulley system housing 442 is located on the top of the outermost section 444 of the central spine 412 and houses a pulley system 490 for the string 448 that moves the upper crown 424. An anchor housing 464 is fixed on to the next section 450 of the central spine 412 which is located within the outermost section 444 of the central spine 412. The anchor housing 464 houses an anchor 466, for the string 448. When section 450 of the central spine 412 moves relative to outermost section 444 of the central spine 412, the string 448 moves the upper crown 424 up or down along the central spine 412. The string 448 in one alternative is also used to allow some movement in the anchor housing 464 without moving the upper crown 424. This is an advantage when optimising the lengths of the sections for the central spine 412. The string 448 is formed in a string loop from the anchor 466 up and over the top pulley system 490 which is housed in the top pulley system housing 442, down through the upper crown 424 and over the lower pulley system 492 which is housed within the lower crown 438. The string 448 then goes up through the upper crown 424, where a knot 494 is formed so that when the central spine 412 is being opened, the knot 494 moves up away from the upper crown 424 until the string 448 is tight and as such pulls the upper crown 424 upwards opening the collapsible canopy framework 416 and thus the main canopy 418. When the central spine 412 is being closed, the string 448 moves the other way, the string 448 is loose and there is no movement on the upper crown 424 until the knot above the upper crown 424 makes contact with the upper crown 424. Thereafter, upper crown 424 moves down as the central spine 412 is being closed, folding the collapsible canopy framework 416 and thus the main canopy 418 to its closed configuration.

Referring to FIGS. 23*a* and 23*b* these illustrate the top of the central spine, upper crown and lower crown according to a sixth embodiment of the present invention. In FIGS. 23*a* and 23*b* the opening and closing action of the collapsible canopy framework 516 and thus the main canopy 518 is facilitated by the movement of the upper crown 524 relative to the lower crown 538 around the central spine 512, which could be incorporated to be part of a telescopic central handle. In this case the upper crown 524 is pulled up by a spring and pulley system connected to the segment of the central spine 512. When handle 514 is pulled open, a string 548 attached to inner section 550 of the central spine 512 pulls the upper crown 524 up opening the collapsible canopy framework 516 and thus the main canopy 518. The upper section 523 of the upper crown 524 is pulled against a compression spring 586 which helps push the upper section 523 of the upper crown 524 when the latch 570 is released to close the collapsible canopy framework 516 and thus the main canopy 518. A spring can 596 also be incorporated in series with the string 548 to give the upper crown 524 the ability to move down when the open umbrella 510 is forced by the wind. This provides a spring action to bring the arms 526 back to their normal open positions.

Figure 23:
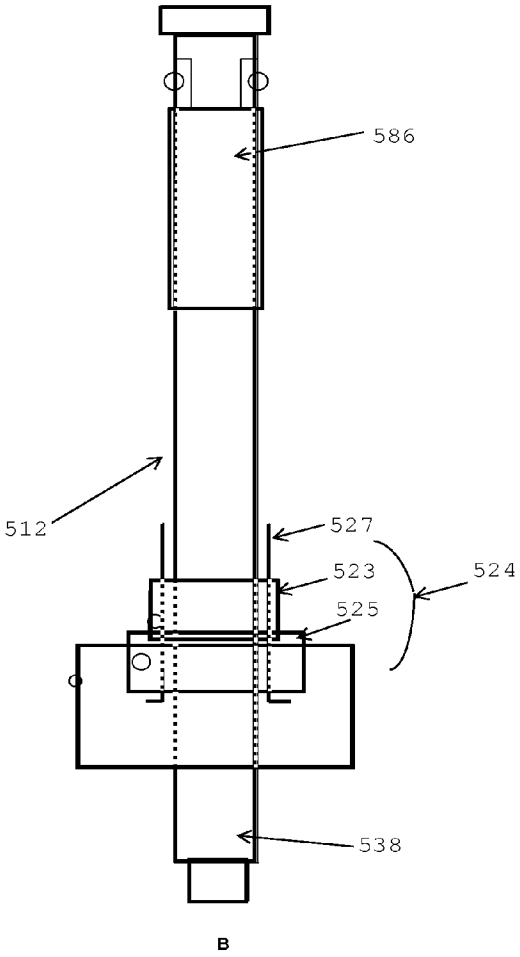
FIGS. 23*a* and 23*b* illustrate the top of the central spine, upper crown and lower crown according to a sixth embodiment of the present invention.
Figure 23:
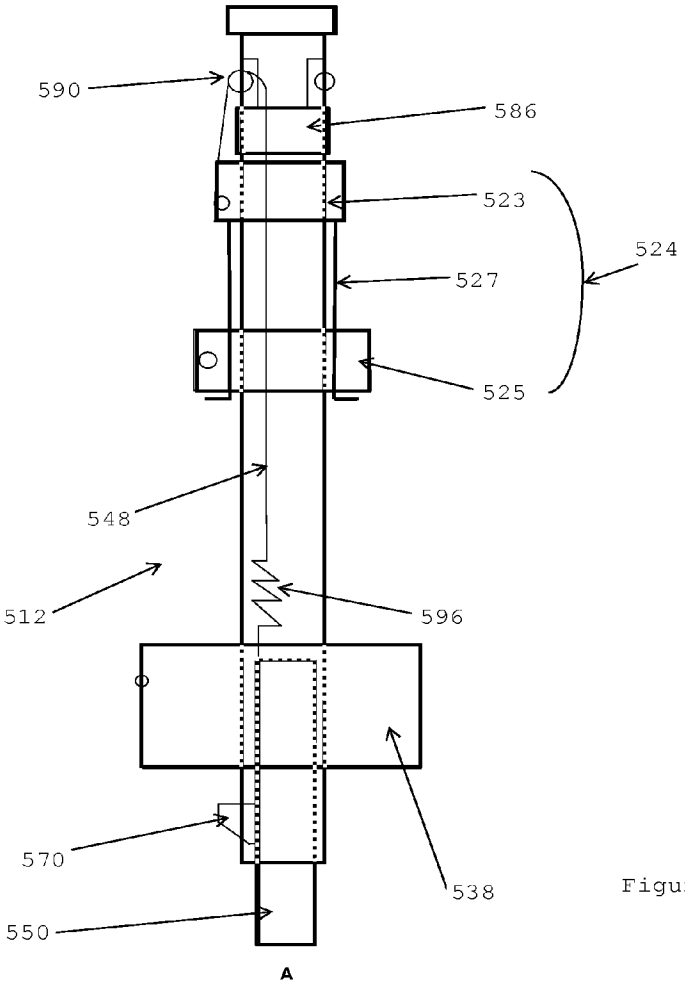

FIG. 23 shows an alternative arrangement to move the upper crown and lower crown relative to each other but in the case it is not required to have a slit on the outermost section 544 of the central spine 512. The lower crown 538 is fixed on to the outermost section 544 of the central spine 512. A spring 596 and a string 548 are connected on to the inner section 550. The other end of the string 548 goes over a pulley 590 and connects on the upper section 523 of the upper crown 524. When the inner section 550 is pulled outwards in the outermost section 544 of the central spine 512, the upper section 523 of the upper crown 524 moves up and when the 527 is tight, this action also moves the lower section 525 of the upper crown 524. This movement away from the lower crown 538 opens up the collapsible canopy framework 516 and thus the main canopy 518. As a consequence of this movement, the compression spring 586 is energised, whilst the umbrella is opened. When the latch 570 is released, the umbrella closes because the spring 586 pushes the upper crown 524 towards the lower crown 538 as shown in FIG. 23*b*.

Figure 24:
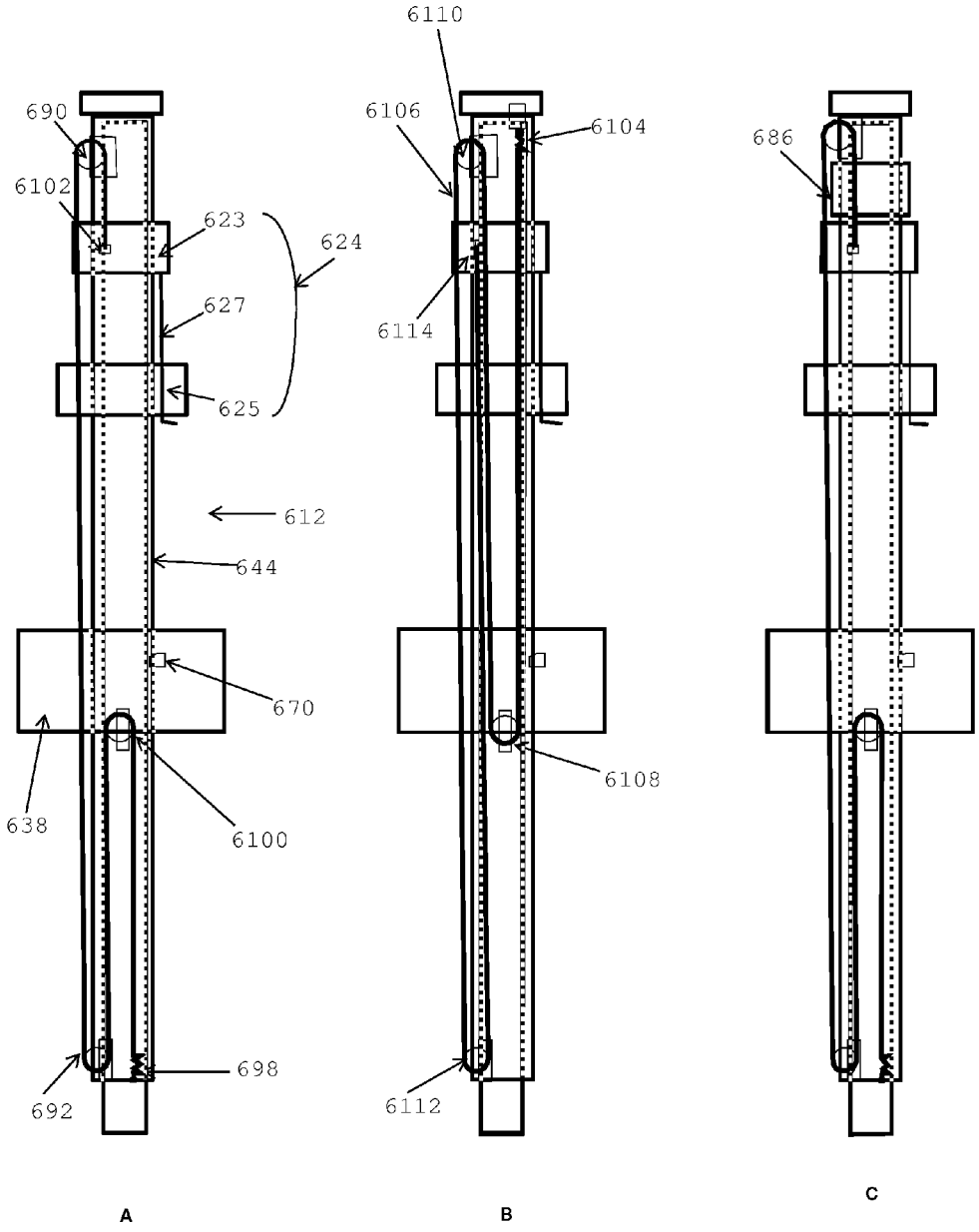
FIGS. 24*a*, 24*b* and 24*c* illustrate the top of the central spine, upper crown and lower crown according to a seventh embodiment of the present invention.

Referring to FIGS. 24*a*, 24*b* and 24*c* these illustrate the top of the central spine, upper crown and lower crown according to a seventh embodiment of the present invention. In FIG. 24, both the upper crown 624 and the lower crown 638 are adapted to slide type over a central spine 612, which could be incorporated to be part of a telescopic central handle. The movement of the upper crown 624 is activated by the movement of the lower crown 638. This again is achieved by string and pulley arrangements, but interestingly, this innovation does not require movement of the sections in the central spine 612 to open or close the umbrella frame. When the lower crown 638 is pushed up, the upper crown 624 moves up at a faster rate opening the gap between the upper crown 624 and the lower crown 638, and therefore opening the frame. When the lower crown 638 is pulled down to close the umbrella, the strings and pulleys are so arranged that the upper crown 624 again moves at a faster rate closing the gap between the upper crown 624 and lower crown 638 and therefore closing the frame. An alternative way of closing the frame is to use the same method as FIG. 23, that is to use a compression spring 686, which is energised when the umbrella is open and when the latch 670 is released, the spring 686 forces closed the umbrella as shown in FIG. 24*c*.

FIG. 24 shows another alternative arrangement to move the supports relative to each other. In this case both the upper crown 624 (upper section 623 and lower section 625) and the lower crown 638 are free to slide over the outermost section 644 of the central spine 612. The spring sling system 698 is fixed on to the bottom end of the outermost section 644 of the central spine 612. The string 648 loops over the pulley 6100 which is fixed on to the lower crown 638. The other end of the string 648 from pulley 6100 loops over the bottom pulley 692 fixed on to the outermost section 644 of the central spine 612. The other end of the string 648 from bottom pulley 692 loops over top pulley 690 and down on to the upper section 623 of the upper crown 624 where it is fixed 6102 as shown on FIG. 24*a* with the upper crown 624 and lower crown 638 in a substantially open configuration. With this arrangement when the lower crown 638 is pushed up over the outermost section 644 of the central spine 612 because the string 648 is double length over the lower crown 638 and single everywhere else, the upper crown 624 moves away from the lower crown.

FIG. 24*b* shows the arrangement for bringing the upper crown 624 towards the lower crown 638 to close the frame. In this case the spring 6104 and string 6106 are fixed close to the top of the outermost section 644 of the central spine 612. The string 6106 is then is looped around the pulley 6108 fixed on to the lower crown 638 and back up on to a pulley 6110 close to the top of the outermost section 644 of the central spine 612. The string 6106 from pulley 6110 is the looped over a pulley 6112 close to the bottom of the outermost section 644 of the central spine 612 and back up and fixed 6114 on to upper section 623 of the upper crown 624. When the lower crown 638 is pulled away from the upper crown 624, the upper crown 624 moves towards the lower crown 638. This is because the string 6106 is double length over the lower crown 638 and single everywhere else and therefore, the movement of the lower crown 638 causes twice the movement on the upper crown 624. FIG. 24*c* shows an alternative way of pushing the upper crown 624 towards the lower crown 638 and this is a compression spring 686 which is energised when the upper crown 624 is forced up away from the lower crown 638.

Figure 25:
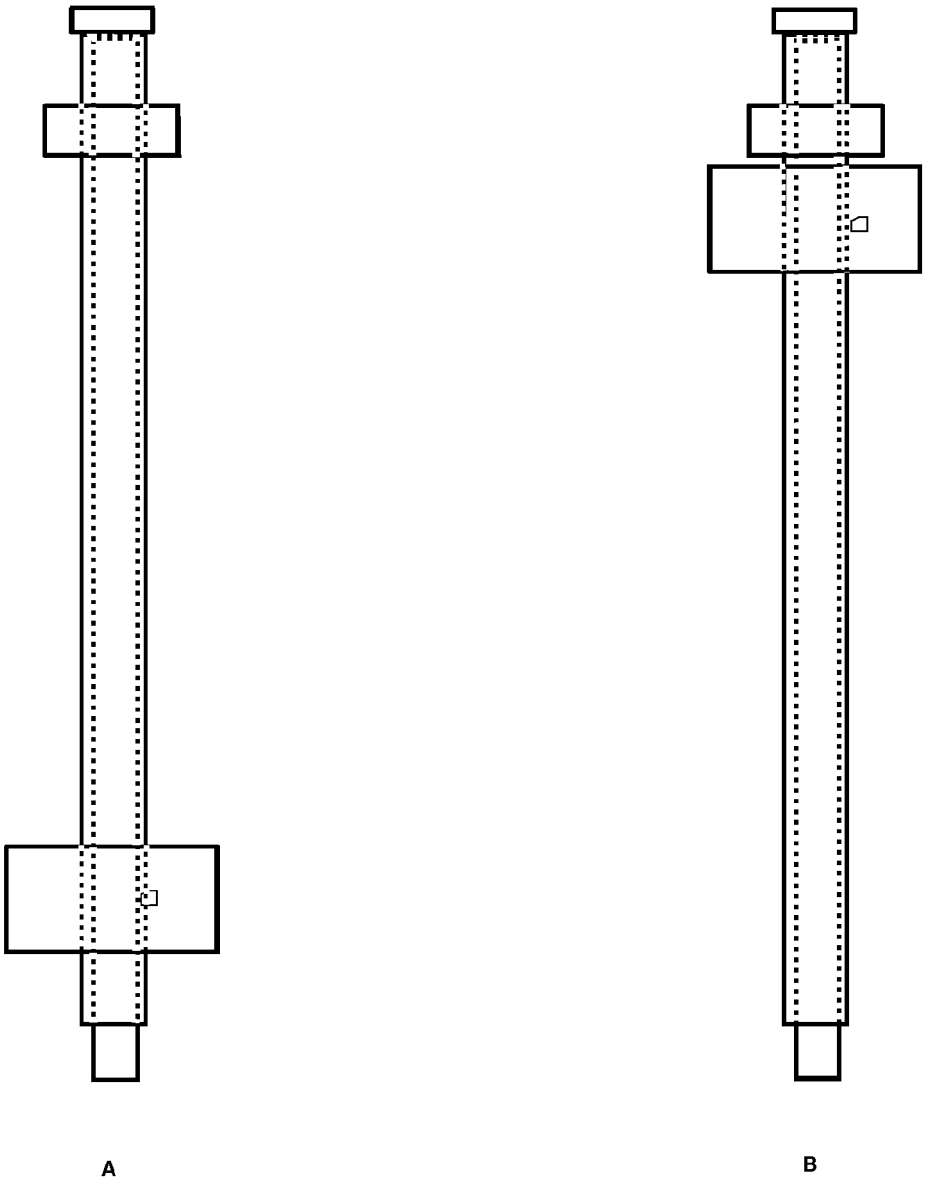
FIGS. 25*a* and 25*b* illustrate the top of the central spine, upper crown and lower crown according to an eighth embodiment of the present invention.

FIGS. 25*a* and 25*b* illustrate the top of the central spine, upper crown and lower crown according to an eighth embodiment of the present invention. In FIG. 25, again both crowns are sliding type over a central spine, which could be incorporated to be part of a telescopic central handle. However in this case the upper crown is fixed and the lower crown is sliding. The movement of the bottom support activated opening and closing of the frame. FIG. 25 illustrates another alternative way of achieving the relative movement between the crowns. In this case the upper crown is fixed and to open the umbrella, the lower crown is pulled away from the top FIG. 25A, and reverse is done when closing the umbrella. This is the same as a standard umbrella however this can be incorporated into a standard type umbrella wherein with the wind resistant hinge mechanism of the outer struts or the gap between the main canopy and the mini canopy from the embodiments already described.

Figure 26:
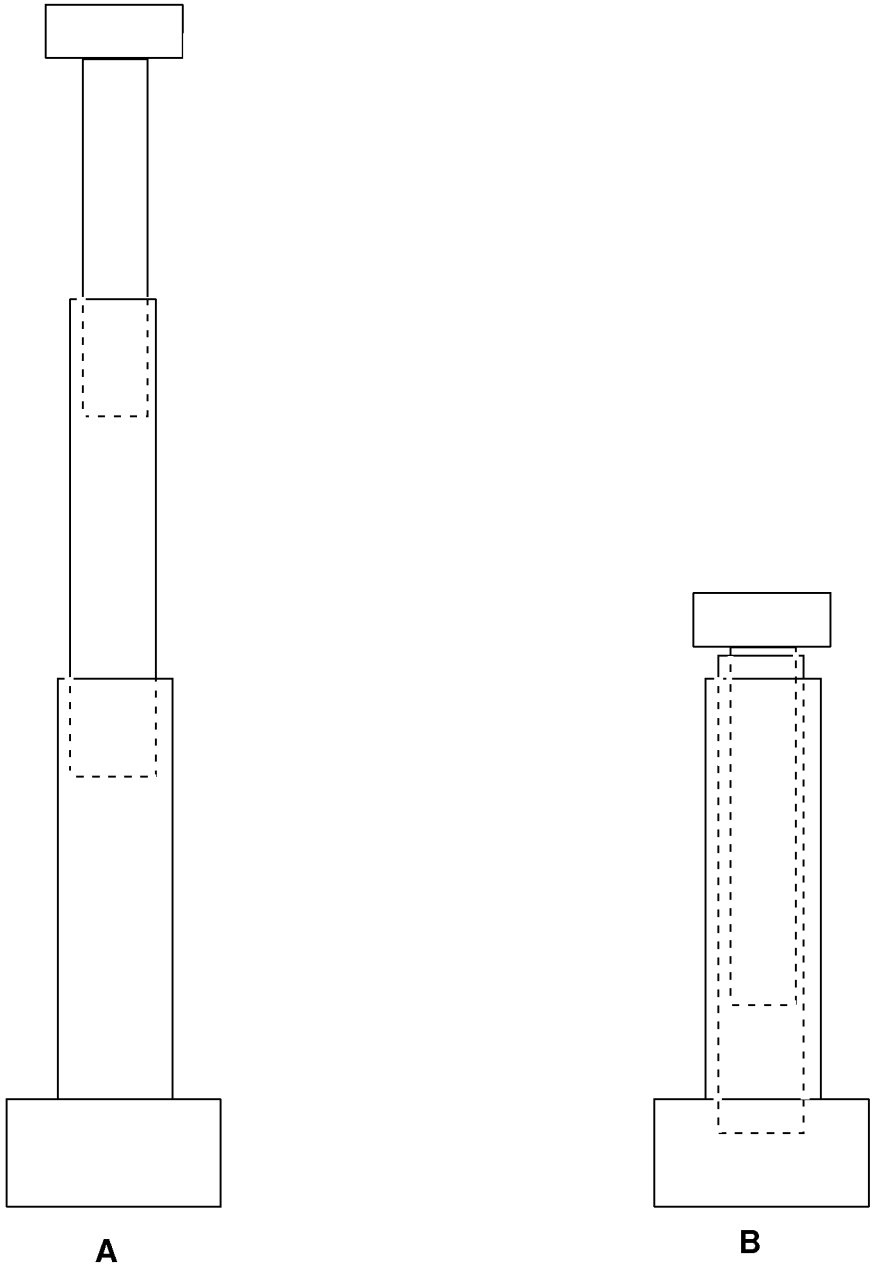
FIGS. 26*a* and 26*b* illustrate the top of the central spine, upper crown and lower crown according to ninth embodiment of the present invention.

FIGS. 26*a* and 26*b* illustrate the top of the central spine, upper crown and lower crown according to ninth embodiment of the present invention. In FIG. 26, both crowns are fixed on to the central spine but the central spine is telescopic so that it can collapse bringing the crowns towards each other. FIG. 26 shows another alternative way of moving the two crowns relative to each other. In this case the two crowns are connected via telescopic connectors. When the telescopic connectors are closed the upper and lower crowns move closer together closing the frame and reverse to open the frame. This is the same as described in a prior art umbrella however this can be incorporated into a new type umbrella with the new wind resistant hinge mechanism of the outer struts or the gap between the main canopy and the mini canopy from the embodiments already described.

All of the above arrangements are equally applicable for either arrangement of the braces and the first arms shown in FIGS. 19 and 20. Either the braces are on top connected to the top supports as shown in FIG. 20 or they are at the bottom connected to the bottom support as shown in FIG. 19.

In this innovation the movement of the supports relative to each other not only actuates the movement of the inner arms and braces, but also actuates the movement of the second arms via a second linkage. The second linkage can either be connected to the same supports as the brace and the inner arms or the top support can be made in two parts one connected to the main arm or brace and the second connected to the second linkage that actuates the second arm.

The present aspects and embodiments represent currently the best ways known to the applicant of putting the invention into practice. But they are not the only ways in which this could be achieved. They are illustrated, and they will now be described, by way of example only.

The present invention primarily relates to umbrellas. It is particularly applicable, but in no way limited, to folding umbrellas in which the umbrella canopy folds inside out and preferably into the umbrella handle or a optional sleeve attached to the handle during storage. This folding arrangement keeps the wet side of the umbrella canopy away from the user and once folded, traps the remaining water within the wet side of the canopy and prevents it from dripping out. The umbrella casing cover or sleeve is so arranged to be an extension of the handle grip and to provide further seal against leakage. Uniquely, this cover is designed to minimise the visual impact on the handle and incorporates a unique lid. The specially developed folding process is also better suited for more compact packing of the fabric minimising its size and weight. Uniquely, the movement of the outer arms are partially uncoupled from the movement of the inner arms. The reason for this is to have the umbrella open in a flowing manner rather than in a disjointed manner. This is done in order to prevent the outer arms clashing onto each other as they fold.

This invention also is inherently more stable and resistant to wind action than conventional umbrellas.

It will be understood that a conventional fabric sleeve could be used to cover an umbrella of this general construction if required.

What is claimed is:

1. A foldaway umbrella moveable between an open configuration and a closed configuration, said umbrella comprising:

a) a central spine;

b) an upper crown moveable with respect to the central spine;

c) a lower crown fixed with respect to the central spine;

d) a canopy framework connected to the upper crown and the lower crown; and e) a main canopy covering the canopy framework said main canopy having an inside face closest to the canopy framework and an outside face remote from the canopy framework;

wherein movement of the upper crown from a position remote of the lower crown to a position close to the lower crown causes the canopy framework, and thus the main canopy, to move from the open configuration to the closed configuration wherein the main canopy is folded inside out such that only the inside face of the main canopy is exposed and wherein movement of the upper crown from a position close to the lower crown to a position remote of the lower crown causes the canopy framework, and thus the main canopy, to move from the closed configuration, wherein the main canopy is folded inside out such that only the inside face of the main canopy is exposed, to the open configuration;

wherein the central spine comprises an outermost section and an inner section, the inner section movable inside the outermost section, the lower crown is fixed to the outermost section of the central spine and the upper crown is moveable with respect to the outermost section of the central spine wherein movement of the inner section of the central spine out of the outermost section of the central spine results in the movement of the upper crown from a position close to the lower crown to a position remote from the lower crown and wherein the inner section of the central spine is connected to the upper crown by a string and pulley system.

2. A foldaway umbrella as claimed in claim 1 wherein the upper crown comprises an upper section and a lower section.

3. A foldaway umbrella as claimed in claim 2 wherein the upper section of the upper crown is movable with respect to the lower section of the upper crown.

4. A foldaway umbrella as claimed in claim 2 wherein the upper section of the upper crown is connected to the lower section of the upper crown with a connecting member.

5. A foldaway umbrella as claimed in claim 1 further comprising a compression spring to move the upper crown from a position remote of the lower crown to a position close to the lower crown.

6. A foldaway umbrella moveable between an open configuration and a closed configuration, said umbrella comprising:

a) central spine;

b) an upper crown moveable with respect to the central spine;

c) a lower crown moveable with respect to the central spine;

d) a canopy framework connected to the upper crown and the lower crown; and e) a main canopy covering the canopy framework said main canopy having an inside face closest to the canopy framework and an outside face remote from the canopy framework;

wherein movement of the upper crown from a position remote of the lower crown to a position close to the lower crown causes the canopy framework, and thus the main canopy, to move from the open configuration to the closed configuration wherein the main canopy is folded inside out such that only the inside face of the main canopy is exposed and wherein movement of the upper crown from a position close to the lower crown to a position remote of the lower crown causes the canopy framework, and thus the main canopy, to move from the closed configuration, wherein the main canopy is folded inside out such that only the inside face of the main canopy is exposed, to the open configuration wherein the upper crown is connected to the lower crown and wherein the upper crown is connected to the lower crown by a string and pulley system.

7. A foldaway umbrella as claimed in claim 6 wherein the upper crown is moveable with respect to the lower crown.

8. A foldaway umbrella as claimed in claim 6 wherein the upper crown is connected to the lower crown by a spring system.

9. A foldaway umbrella as claimed in claim 7 wherein movement of the lower crown results in movement of the upper crown.

10. A foldaway umbrella as claimed in claim 9 wherein the upper crown is adapted to move faster than the lower crown.

* * * * *